US009221561B2

(12) United States Patent
Maheshwari et al.

(10) Patent No.: US 9,221,561 B2
(45) Date of Patent: Dec. 29, 2015

(54) POWDER DISPENSER MODULES AND POWDER DISPENSER ASSEMBLIES

(75) Inventors: Rajesh Maheshwari, Millburn, NJ (US); Rolf Scharger, Winterbach (DE); Trent A. Poole, Amherst, MA (US); Per B. Fog, Bedford Hills, NY (US)

(73) Assignee: MannKind Corporation, Valencia, CA (US)

( * ) Notice: Subject to any disclaimer, the term of this patent is extended or adjusted under 35 U.S.C. 154(b) by 1238 days.

(21) Appl. No.: 13/057,420

(22) PCT Filed: Aug. 5, 2009

(86) PCT No.: PCT/US2009/004500

§ 371 (c)(1),
(2), (4) Date: Mar. 30, 2011

(87) PCT Pub. No.: WO2010/016908

PCT Pub. Date: Feb. 11, 2010

(65) Prior Publication Data

US 2011/0173933 A1 Jul. 21, 2011

Related U.S. Application Data

(60) Provisional application No. 61/188,001, filed on Aug. 5, 2008.

(51) Int. Cl.
*B65B 1/20* (2006.01)
*B65B 1/46* (2006.01)
(Continued)

(52) U.S. Cl.
CPC ... *B65B 1/46* (2013.01); *B65B 1/12* (2013.01); *B65B 1/30* (2013.01); *B65B 1/32* (2013.01); *B65B 37/14* (2013.01); *B65B 57/145* (2013.01)

(58) Field of Classification Search
CPC ..... B65B 37/10; B65B 1/12; B65B 1/30; B65B 1/32; B65B 1/46; B65B 37/14; B65B 57/145
USPC ..... 141/71–72, 256, 12; 222/410, 412
See application file for complete search history.

(56) References Cited

U.S. PATENT DOCUMENTS 3,047,034 A * 7/1962 Sassmannshausen et al. ..... 141/311 R
3,353,208 A 11/1967 Fergus
(Continued)

FOREIGN PATENT DOCUMENTS

CN 2174424 Y 8/1994
CN 1231988 A 10/1999
(Continued)

OTHER PUBLICATIONS

Examination Report dated Nov. 15, 2012 from corresponding Singapore Patent Application No. 201100810-9.
(Continued)

*Primary Examiner* — Jason K Niesz
(74) *Attorney, Agent, or Firm* — Wolf, Greenfield & Sacks, P.C.

(57) ABSTRACT

A powder dispenser module (54) includes a housing (150) that defines a conduit connecting a powder inlet and a powder outlet, a feed wand (160) to move powder through the conduit from the powder inlet to the powder outlet, the feed wand (200) including a lower feed element (230) coupled to a first drive shaft and an upper feed element (220) coupled to a second drive shaft, a first actuator coupled to the first drive shaft to rotate the lower feed element (230), and a second actuator coupled to the second drive shaft to rotate the upper feed element (220). In other embodiments, the feed wand (200) includes a shaft having a fluidizing element and an actuator produces oscillatory movement of the feed wand during dispensing of powder. Dispenser module arrays include one or a few rows of dispenser modules.

17 Claims, 24 Drawing Sheets

(51) Int. Cl.

| | |
|---|---|
| ***B65B 1/12*** | (2006.01) |
| ***B65B 1/30*** | (2006.01) |
| ***B65B 1/32*** | (2006.01) |
| ***B65B 37/14*** | (2006.01) |
| ***B65B 57/14*** | (2006.01) |

(56) References Cited

U.S. PATENT DOCUMENTS

| | | | | |
|---|---|---|---|---|
| 3,593,371 | A | | 7/1971 | Driscoll |
| 4,127,054 | A | * | 11/1978 | Gully ..... 86/23 |
| 4,145,197 | A | | 3/1979 | Strahsner et al. |
| 4,164,244 | A | * | 8/1979 | Meier ..... 141/156 |
| 4,185,669 | A | | 1/1980 | Jevakohoff |
| 4,371,295 | A | | 2/1983 | Hart |
| 4,374,540 | A | | 2/1983 | Massey et al. |
| 4,629,093 | A | | 12/1986 | Le Molaire |
| 4,956,271 | A | | 9/1990 | Milone |
| 5,038,839 | A | | 8/1991 | Morimoto et al. |
| 5,109,893 | A | | 5/1992 | Derby |
| 5,109,894 | A | | 5/1992 | McGregor |
| 5,233,916 | A | | 8/1993 | Butler et al. |
| 5,327,947 | A | | 7/1994 | McGregor |
| 5,352,461 | A | | 10/1994 | Feldstein et al. |
| 5,407,079 | A | | 4/1995 | Rancourt |
| 5,503,852 | A | | 4/1996 | Steiner et al. |
| 5,549,144 | A | | 8/1996 | Dworak et al. |
| 5,598,876 | A | | 2/1997 | Zanini et al. |
| 5,654,007 | A | | 8/1997 | Johnson et al. |
| 5,727,607 | A | | 3/1998 | Ichikawa et al. |
| 5,765,607 | A | | 6/1998 | Ansaloni |
| 5,826,633 | A | | 10/1998 | Parks et al. |
| 5,922,354 | A | | 7/1999 | Johnson et al. |
| 6,021,821 | A | | 2/2000 | Wegman |
| 6,035,905 | A | | 3/2000 | Griffin |
| 6,071,497 | A | | 6/2000 | Steiner et al. |
| 6,102,088 | A | | 8/2000 | Wegman |
| 6,103,270 | A | | 8/2000 | Johnson et al. |
| 6,119,688 | A | | 9/2000 | Whaley et al. |
| 6,121,556 | A | | 9/2000 | Cole |
| 6,182,712 | B1 | | 2/2001 | Stout et al. |
| 6,240,918 | B1 | | 6/2001 | Ambrosio et al. |
| 6,267,155 | B1 | | 7/2001 | Parks et al. |
| 6,306,199 | B1 | | 10/2001 | Gustafson et al. |
| 6,340,036 | B1 | | 1/2002 | Toyoizumi et al. |
| 6,346,680 | B1 | | 2/2002 | Takahashi et al. |
| 6,347,648 | B1 | | 2/2002 | Wegman et al. |
| 6,357,490 | B1 | | 3/2002 | Johnston et al. |
| 6,428,771 | B1 | | 8/2002 | Steiner et al. |
| 6,444,226 | B1 | | 9/2002 | Steiner et al. |
| 6,581,650 | B2 | | 6/2003 | Parks et al. |
| 6,644,364 | B1 | | 11/2003 | Feygin |
| 6,652,885 | B2 | | 11/2003 | Steiner et al. |
| 6,668,874 | B2 | | 12/2003 | Rowland et al. |
| 6,674,022 | B2 | | 1/2004 | Fermier et al. |
| 6,679,256 | B2 | | 1/2004 | Ingle et al. |
| 6,679,301 | B2 | | 1/2004 | Makino et al. |
| 6,715,259 | B2 | | 4/2004 | Johnston et al. |
| 6,722,403 | B2 | | 4/2004 | Zhou et al. |
| 6,722,406 | B2 | | 4/2004 | Wegman et al. |
| 6,772,801 | B1 | | 8/2004 | Shojaei et al. |
| 6,800,818 | B2 | | 10/2004 | Balboni et al. |
| 6,871,758 | B2 | | 3/2005 | Berenshteyn et al. |
| 6,875,278 | B2 | | 4/2005 | Kerbel et al. |
| 6,889,722 | B2 | | 5/2005 | Huss |
| 6,923,175 | B2 | | 8/2005 | Poole et al. |
| 6,941,980 | B2 | | 9/2005 | Rocchio et al. |
| 6,959,522 | B2 | | 11/2005 | Johnston et al. |
| 7,004,210 | B1 | | 2/2006 | Wegman et al. |
| 7,048,018 | B2 | | 5/2006 | Ghizzi et al. |
| 7,069,963 | B2 | | 7/2006 | Friberg et al. |
| 7,090,391 | B2 | | 8/2006 | Taniguchi |
| 7,134,459 | B2 | | 11/2006 | Carlson et al. |
| 7,614,429 | B2 | | 11/2009 | Pluvinage et al. |
| 7,621,300 | B2 | | 11/2009 | Bonney et al. |
| 7,669,617 | B2 | | 3/2010 | Parks et al. |
| 7,980,277 | B2 | | 7/2011 | Amano |
| 2001/0038018 | A1 | | 11/2001 | Bell et al. |
| 2003/0066481 | A1 | | 4/2003 | Kerbel et al. |
| 2004/0038865 | A1 | | 2/2004 | Gelber et al. |
| 2004/0168400 | A1 | | 9/2004 | Johnston et al. |
| 2004/0173281 | A1 | | 9/2004 | Bates et al. |
| 2004/0182387 | A1 | | 9/2004 | Steiner et al. |
| 2005/0056339 | A1 | | 3/2005 | Beane |
| 2005/0173552 | A1 | | 8/2005 | Friberg et al. |
| 2005/0211244 | A1 | | 9/2005 | Nilsson et al. |
| 2006/0137760 | A1 | | 6/2006 | Dubois et al. |
| 2007/0130887 | A1 | | 6/2007 | Weder |
| 2007/0131707 | A1 | * | 6/2007 | Poole et al. ..... 222/14 |
| 2007/0131708 | A1 | | 6/2007 | Poole et al. |
| 2007/0151623 | A1 | | 7/2007 | Poole et al. |
| 2011/0023995 | A1 | | 2/2011 | Poole et al. |
| 2011/0079318 | A1 | | 4/2011 | Poole et al. |
| 2011/0108157 | A1 | | 5/2011 | Scharger |
| 2011/0197990 | A1 | | 8/2011 | Poole et al. |
| 2012/0255645 | A1 | | 10/2012 | Poole et al. |

FOREIGN PATENT DOCUMENTS

| | | | |
|---|---|---|---|
| CN | 2361562 | Y | 2/2000 |
| CN | 2806313 | | 8/2006 |
| DE | 40 37 459 | | 5/1992 |
| DE | 44 47 051 | A1 | 7/1996 |
| DE | 102006018279 | A1 | 10/2007 |
| EP | 0826386 | A2 | 3/1998 |
| EP | 0874289 | A2 | 10/1998 |
| EP | 0 989 383 | A2 | 3/2000 |
| EP | 1 380 501 | A2 | 1/2004 |
| EP | 0 831 782 | B1 | 12/2005 |
| GB | 369450 | | 3/1932 |
| JP | S45-000232 | U | 1/1970 |
| JP | H2069627 | U1 | 5/1990 |
| JP | 2108729 | U1 | 8/1990 |
| JP | 2242701 | A | 9/1990 |
| JP | H4078194 | U1 | 7/1992 |
| JP | 4-128205 | U1 | 11/1992 |
| JP | 6-154669 | | 6/1994 |
| JP | 6286884 | A | 10/1994 |
| JP | 725479 | A | 1/1995 |
| JP | 07011313 | A2 | 1/1995 |
| JP | 858914 | A | 3/1996 |
| JP | H08-253201 | A | 10/1996 |
| JP | 11188771 | A2 | 7/1999 |
| JP | 02194846 | A2 | 8/1999 |
| JP | 2001041812 | A2 | 2/2001 |
| JP | 2003-509294 | A | 3/2003 |
| JP | 2003531705 | T2 | 10/2003 |
| JP | 2003-533415 | A | 11/2003 |
| JP | 2004-115021 | | 4/2004 |
| JP | 2004-284620 | | 10/2004 |
| JP | 2004307042 | A2 | 11/2004 |
| JP | 2005065821 | A2 | 3/2005 |
| JP | 2005-239235 | | 9/2005 |
| WO | WO 93/18812 | A1 | 9/1993 |
| WO | WO 97/018991 | | 5/1997 |
| WO | WO 98/30263 | A1 | 7/1998 |
| WO | WO 99/44663 | A1 | 9/1999 |
| WO | WO 01/017595 | | 3/2001 |
| WO | WO 03/100530 | | 12/2003 |
| WO | WO 2007/061987 | | 5/2007 |
| WO | WO 2008/082640 | | 7/2008 |

OTHER PUBLICATIONS

Office Action dated Apr. 11, 2012 from European Patent Application No. 09789071.9.

Written Opinion mailed Mar. 5, 2012 from Singapore Patent Application No. 201100810-9.

Written Opinion mailed Feb. 17, 2011 from International Application No. PCT/US2009/004500.

Search Report dated Jul. 1, 2008 for European Patent Application No. 08006350.6.

Search Report dated Jul. 1, 2008 for European Patent Application No. 08006324.1.

(56) References Cited

OTHER PUBLICATIONS

Office Action dated Sep. 11, 2008 for European Application No. 06844452.0.
Invitation to Pay Additional Fees and Partial Search Report dated Dec. 14, 2009 for International Application No. PCT/US2009/004500.
Search Report and Examination Report mailed Jan. 11, 2010 for Singapore Application No. 200803358-1.
Extended Search Report dated Nov. 22, 2013 from corresponding European Application No. 13187508.0.
Search Report and Written Opinion mailed Jul. 7, 2011 for related Singapore Patent Application No. 201100810-9.
Search Report dated Oct. 13, 2011 for related European Application No. 10160429.6.
English translation of an Office Action and Search Report dated Oct. 29, 2014 from corresponding Chinese Application No. 201310322500.2.
English translation of an Office Action dated Feb. 10, 2015 from Japanese Application No. 2014-020498.
Examination Report dated Mar. 25, 2015 from Indian Application No. 4298/DELNP/2008.
Office Action dated Jul. 16, 2013 from Japanese Application No. 2011-522061.
Office Action dated Aug. 6, 2013 from Japanese Application No. 2012-138928.
Office Action dated Dec. 3, 2013 from Chinese Application No. 201110401972.8.

* cited by examiner

POWDER DISPENSER MODULES AND POWDER DISPENSER ASSEMBLIES

CROSS REFERENCE TO RELATED APPLICATION

This application is a national stage of PCT/US2009/004500, filed Aug. 5, 2009, which claims priority based on Provisional Application Ser. No. 61/188,001, filed Aug. 5, 2008, which are hereby incorporated by reference in their entirety.

FIELD OF THE INVENTION

This invention relates to methods and apparatus for dispensing and sensing powder and, more particularly, to methods and apparatus for dispensing precisely-controlled quantities of powder into multiple cartridges and for individually sensing the fill state of each of the cartridges. The powder can contain a drug, and the cartridges can be used in an inhaler. However, the invention is not limited to this application.

BACKGROUND OF THE INVENTION

It has been proposed to deliver certain types of drugs to patients by inhalation of a powder as a delivery mechanism. An inhaler having a replaceable cartridge or capsule containing the drug powder is used for drug delivery. The administration of drugs by inhalation typically requires a very small quantity of powder in the inhaler cartridge. By way of example, application of insulin using Technosphere® microparticles can require a dose of as little as 10 milligrams of the powder. In addition, the drug dose must be highly accurate. A dose lower than specified may not have the desired therapeutic effect, while a larger than specified dose can have an adverse effect on the patient. Furthermore, while Technosphere microparticles are highly effective for drug delivery by inhalation, their platelet surface structure causes Technosphere powders to be cohesive and somewhat difficult to handle.

In the commercialization of drug delivery by inhalation, large numbers of cartridges containing the drug must be produced in an efficient and economical manner. An accurate dose of powder must be delivered to each cartridge, and the drug dose in each cartridge must be verified. Manufacturing techniques and equipment should be capable of high throughput to meet demand and should be capable of handling powders which are cohesive and thus do not flow freely. Existing manufacturing techniques and equipment have not been adequate to meet these demands.

International Publication No. WO 2007/061987, published 31 May 2007, discloses systems and methods for simultaneously dispensing precisely-controlled doses of a powder into multiple cartridges. The powder can contain a drug, and the cartridges can be used in inhalers. The fill state of each cartridge, typically the powder weight, is sensed during filling, and powder dispenser modules are individually controlled in response to the sensed weight to insure accurate dosage. The system operates at high speed and can be very compact to enable production filling operations with minimum floor space requirements. Nonetheless, there is a need for improved methods and apparatus for powder dispensing.

SUMMARY OF THE INVENTION

Systems and methods are provided for simultaneously dispensing precisely-controlled doses of a powder into multiple cartridges. The powder can contain a drug, and the cartridges can be used in inhalers. The fill state of each cartridge, typically the powder weight, is sensed during filling, and powder dispenser modules are individually controlled in response to the sensed weight to ensure accurate dosage. The system operates at high speed and can be very compact to enable production filling operations with minimal floor space requirements.

According to a first aspect of the invention, a powder dispenser module comprises: a housing that defines a powder inlet for receiving a powder, a powder outlet, and a conduit connecting the powder inlet and the powder outlet; a feed wand to move powder through the conduit from the powder inlet to the powder outlet, the feed wand including a lower feed element coupled to a first drive shaft and an upper feed element coupled to a second drive shaft; a first actuator coupled to the first drive shaft to rotate the lower feed element; and a second actuator coupled to the second drive shaft to rotate the upper feed element.

According to a second aspect of the invention, a powder dispenser module comprises: a housing that defines a powder inlet for receiving a powder, a powder outlet, and a conduit connecting the powder inlet and the powder outlet; a feed wand assembly to move powder through the conduit from the powder inlet to the powder outlet; a valve to control the powder outlet, wherein the valve includes a valve member that rotates about an axis perpendicular to an axis of the feed wand assembly; and a valve actuator to operate the valve between open and closed positions.

According to a third aspect of the invention, powder dispensing and sensing apparatus comprises: a support structure to receive a cartridge holder configured to hold cartridges; a powder dispenser assembly including powder dispenser modules to dispense powder into the cartridges; a powder transport system to deliver powder to the powder dispenser modules; a sensor module including a plurality of sensor cells to sense respective fill states of each of the cartridges; and a control system to control the powder dispenser modules in response to the respective sensed fill states of each of the cartridges, wherein the control system includes an embedded processor in each of the powder dispenser modules, each embedded processor communicating with a respective sensor cell and elements of the powder dispenser module.

According to a fourth aspect of the invention, a method for dispensing powder into a cartridge comprises: positioning a cartridge under a dispenser module having a conduit containing a powder and a valve at a lower end of the conduit; with the valve closed, operating an upper feed element in the conduit while maintaining a lower feed element stationary; opening the valve; operating the upper feed element and the lower feed element in the conduit to dispense powder through the open valve to the cartridge; and closing the valve when a desired fill state of the cartridge is reached.

According to a fifth aspect of the invention, powder dispensing and sensing apparatus comprises: a support structure to receive a cartridge holder configured to hold at least one row of cartridges; a powder dispenser assembly including powder dispenser modules to dispense powder into respective cartridges in the at least one row of cartridges, wherein the powder dispenser assembly includes an array having one or more rows of powder dispenser modules; a powder transport system to deliver powder to the powder dispenser modules; a sensor module including a plurality of sensor cells to sense respective fill states of each of the cartridges in the at least one row of cartridges; a control system to control the powder dispenser modules in response to the respective sensed fill states of each of the cartridges of the at least one row of cartridges; and an actuator to move the at least one row of cartridges relative to the array of powder dispenser modules.

According to a sixth aspect of the invention, a powder dispenser module comprises: a housing that defines a powder inlet for receiving a powder, a powder outlet, and a powder chamber connecting to the powder inlet and the powder outlet; a feed wand including a valve element to close the powder outlet and a fluidizing element to fluidize the powder; and an actuator to produce oscillatory movement of the feed wand during dispensing of the powder.

According to a seventh aspect of the invention, a method for dispensing powder into a cartridge comprises: positioning a cartridge under a dispenser module having a powder chamber containing a powder and a valve at the lower end of the powder chamber; opening the valve; dispensing powder through the open valve to the cartridge by oscillatory movement of a feed wand having a fluidizing element in the powder chamber; and closing the valve when a desired fill state of the cartridge is reached.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
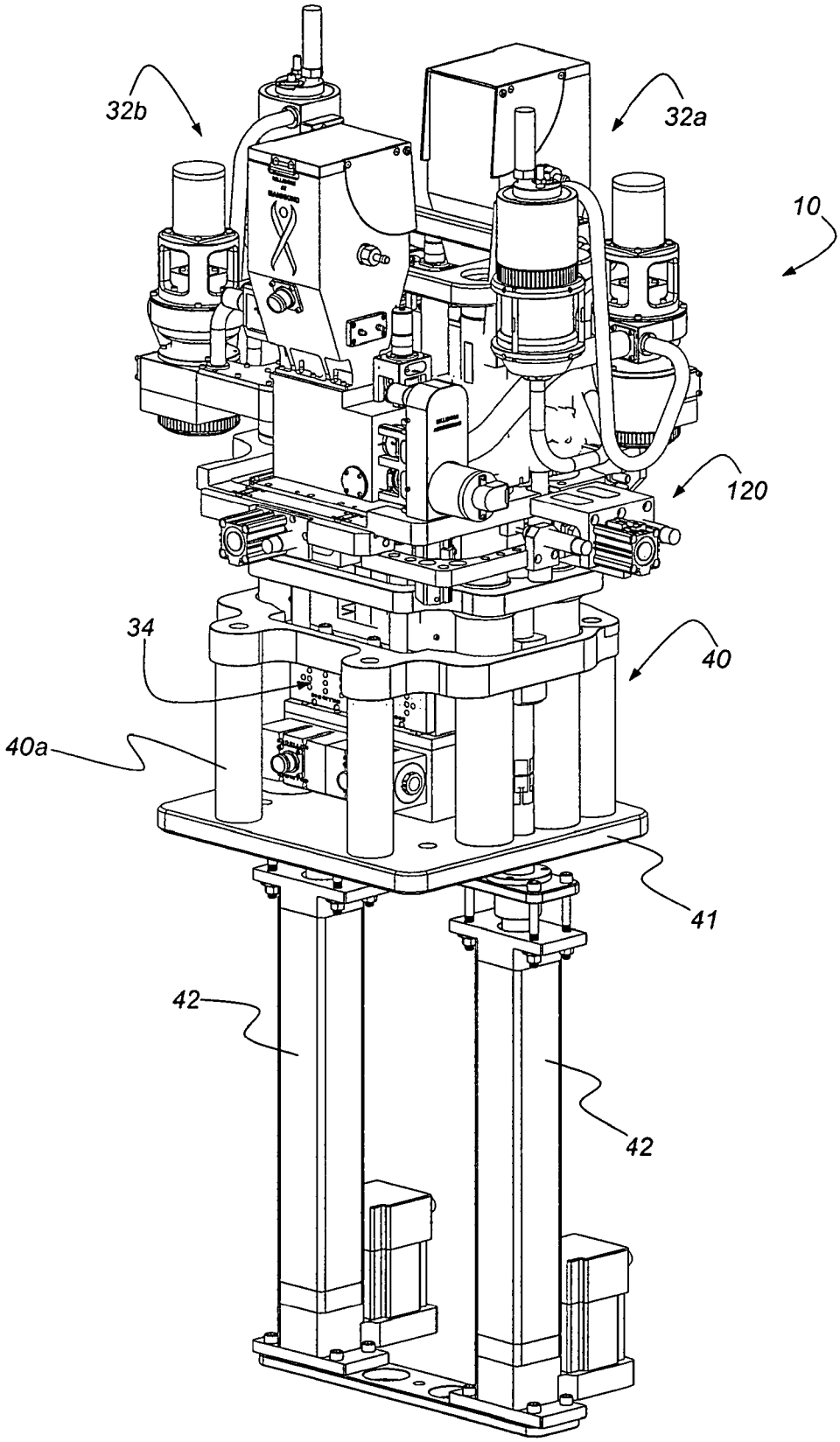
FIG. 1 is a perspective view of a powder dispensing and sensing apparatus in accordance with an embodiment of the invention.

A powder dispensing and sensing apparatus 10 is shown FIGS. 1-7. A purpose of the apparatus is to dispense powder into multiple cartridges 20 and to sense and control a fill state of each of the cartridges, so that each of the cartridges receives a precisely-controlled quantity of the powder. As used herein, the term "cartridge" refers to any container or capsule that is capable of holding a powder, typically a powder containing a drug substance. As used herein, the term "fill" includes filled and partially filled, since each cartridge is typically not filled to capacity and in fact may be filled to only a small fraction of its capacity. As described below, the apparatus can be used to fill an inhaler cartridge or a compact inhaler, but is not necessarily limited as to the type of container to be filled.

Cartridges 20 can be held in a cartridge tray 22 that is positioned in a tray support frame 24 for processing. The cartridges can be held in an array of rows and columns. In one example, cartridge tray 22 holds forty-eight cartridges 20 in a 6×8 array. The configuration of cartridge tray 22 and the corresponding configuration of apparatus 10 are given by way of example only and are not limiting as to the scope of the invention. It will be understood that cartridge tray 22 can be configured to hold a different number of cartridges and that cartridge tray 22 can have a different array configuration within the scope of the invention. In another embodiment described below, the cartridge tray can hold 192 cartridges. Cartridge tray 22 can be placed in support frame 24 and removed from support frame 24 by a robot.

Components of powder dispensing and sensing apparatus 10, in addition to tray support frame 24, include a powder dispenser assembly 30 to dispense powder into cartridges 20, a powder transport system 32 to deliver powder to powder dispenser assembly 30 and a sensor module 34 to sense a fill state of each of cartridges 20. Powder dispensing and sensing apparatus 10 further includes a frame 40 for mounting of tray support frame 24, powder dispenser assembly 30, powder transport system 32 and sensor module 34, and actuators 42 to move powder dispenser assembly 30 and powder transport system 32 with respect to cartridges 20.

Figure 8:
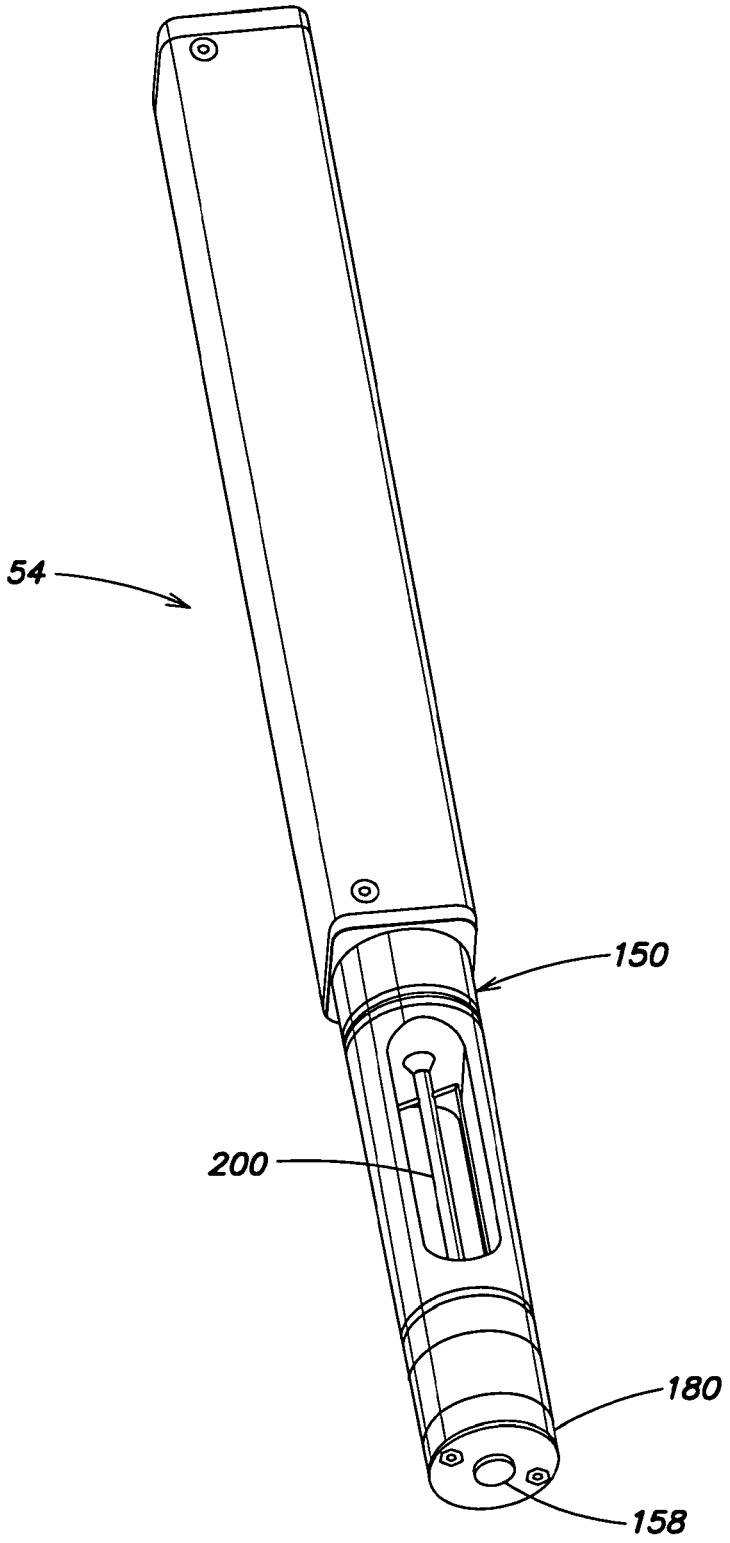
FIG. 8 is a perspective view of a powder dispenser module in accordance with embodiments of the invention.

Powder dispenser assembly 30 includes an array block 50 having an array of vertical ports 52 and a powder dispenser module 54 mounted in each of the vertical ports of array block 50. Array block 50 can be configured to match the array of cartridges 20 in cartridge tray 22 or a subset of the cartridges in the cartridge tray. In the above example of a cartridge tray that holds forty-eight cartridges, array block 50 can have a 6×8 array of vertical ports 52 and provides mounting for forty-eight powder dispenser modules 54. In this embodiment, powder dispenser modules 54 are mounted on one-inch centers. It will be understood that a different spacing arrangement can be utilized within the scope of the invention. As shown in FIG. 8, array block 50 further includes powder storage and transport channels 60*a*, 60*b*, 60*c*, 60*d*, 60*e*, 60*f*, 60*g* and 60*h*, with one channel for each row of six powder dispenser modules 54 in this embodiment. Powder is delivered by powder transport system 32 to powder dispenser modules 54 through each channel in array block 50, as described below. Each channel preferably has sufficient volume to store powder for several powder dispensing cycles.

In the embodiment of FIGS. 1-7, powder transport system 32 includes a first powder transport system 32*a* to deliver powder to a first group of four channels 60*a*, 60*b*, 60*c* and 60*d* in array block 50 and a second powder transport system 32*b* to deliver powder to a second group of four channels 60*e*, 60*f*, 60*g* and 60*h* in array block 50. Each of powder transport systems 32*a* and 32*b* includes a blower assembly 70 to move a transport gas through the powder transport system, a powder aerator 72 to deliver powder to powder dispenser assembly 30 and a hopper assembly 74 to supply powder to powder aerator 72. In other embodiments, a single powder transport system or more than two powder transport systems can be utilized.

Blower assembly 70 is coupled through a tube 76 to a gas inlet 78 of powder aerator 72 and produces a flow of transport gas through gas inlet 78. Powder aerator 72 includes a powder inlet 80 to receive powder from hopper assembly 74. The powder is delivered by powder aerator 72 through four powder output ports 82 to inlet ends of respective channels in array block 50. The powder is transported through the respective channels to the powder dispenser modules 54 in each row of powder dispenser assembly 30. The powder is individually dispensed to cartridges 20 by powder dispenser modules 54 as described below.

Channels 60*a*-60*h* pass through array block 50, and a tuned suction manifold 84 is coupled to outlet ends of the channels. The suction manifold 84 of first powder transport system 32*a* is connected to outlet ends of channels 60*a*-60*d*, and the suction manifold 84 of second powder transport system 32*b* is connected to the outlet ends of channels 60*e*-60*h*. Suction manifold 84 returns the transport gas to blower assembly 70, thus forming a closed loop recirculating gas transport system. In other embodiments, the powder transport system can utilize an open loop gas transport system. Any powder not delivered to powder dispenser modules 54 or stored in the channels returns through suction manifold 84 to blower assembly 70. As discussed below, blower assembly 70, in some embodiments, can include a gas-particle separation device to retain large powder agglomerates, while small powder agglomerates are recirculated to powder aerator 72 for delivery to powder dispenser assembly 30. As further discussed below, each powder transport system can include a gas conditioning unit to control the relative humidity and/or temperature of the recirculating transport gas.

The powder transport system 32 can include sensors to determine the powder level in different components of the powder transport system. Hopper assembly 74 can include a hopper level sensor to sense the powder level in the reservoir of hopper assembly 74. Powder aerator 72 can include a dump valve level sensor to determine the powder level in the dump valve of powder aerator 72. The blower assembly 70 can include a large agglomerate level sensor. A dispenser fill level sensor can be located at the suction manifold 84 of blower assembly 70. The powder level sensors can use optical techniques to sense powder level, for example. The powder level sensors can be used to control operation of powder delivery system 32 and loading of powder dispenser modules 54 with powder.

Sensor module 34 can include a sensor housing and an array of sensor assemblies 110 mounted in the sensor housing. In the illustrated embodiment, each of the sensor assemblies 110 includes two sensor cells 114 (FIG. 3) and associated circuitry. Thus, one sensor assembly 110 is used with two powder dispenser modules 54. In other embodiments, each sensor assembly can include a single sensor cell or more than two sensor cells. The number of sensor assemblies 110 and the arrangement of sensor assemblies 110 in the array can be such that the sensor cells 114 match the configuration of cartridges 20 in cartridge tray 22 or a subset of the cartridges in the cartridge tray. For the example of a cartridge tray 22 that holds forty-eight cartridges 20 in a 6×8 array on one inch centers, the sensor module 34 can include twenty-four sensor assemblies 110, which provide forty-eight sensor cells 114 in a 6×8 array on one inch centers. In the embodiment of FIGS. 1-7, each of the sensor cells 114 is a weight sensor to sense the weight of the powder delivered to the respective cartridge 20. A weight sensor probe 112 is affixed to each of the sensor cells 114 and contacts a lower end of cartridge 20 through an opening in cartridge tray 22.

The sensor cells 114 individually sense the fill state of each of cartridges 20 during dispensing of powder, so that powder dispensing can be terminated when the desired amount of powder has been dispensed into each cartridge 20. The sensor cells 114 are preferably weight sensors which monitor the weight of cartridge 20 during the powder dispensing process and are accurate within 5 to 10 micrograms in the present embodiment. An electrobalance beam is typically used as a weight sensor in applications requiring high accuracy, high speed and repeatability with very small weights.

The physical configuration of the weight sensor assembly 110 is a consideration in systems where powder dispenser modules 54 are closely spaced, such as on one inch centers. Preferably, the weight sensor assemblies 110 can be placed in an array that matches the configuration of cartridge tray 22 and powder dispenser modules 54. In a preferred embodiment, sensor assemblies 110 have a vertical configuration and two sensor cells 114 are packaged together to form a sensor assembly. The weight sensing mechanical components are located at the top of the assembly, electrical circuitry is located below the mechanical components and an electrical connector is located at the bottom. The sensor assemblies can be mounted in an array for weight sensing on one inch centers.

In another embodiment, a commercially available weight sensor module has a horizontal configuration and can be utilized in a tiered arrangement on three different levels for an array having six cartridges per row. In the tiered arrangement, probes of different lengths are used to contact the cartridges.

The powder dispensing and sensing apparatus 10 has been described as having powder dispenser modules 54 and sensor cells 114 mounted on one inch centers. It will be understood that a larger or smaller spacing between components can be utilized within the scope of the invention. Further, the components of the apparatus 10 are not necessarily mounted in a uniform array. For example, the x-direction spacing between components can be different from the y-direction spacing between components, or a row of the array can be offset with respect to an adjacent row.

In operation, cartridge tray 22 holding cartridges 20 is positioned in tray support frame 24, preferably by a robot or other automation mechanism. Cartridge tray 22 is lowered so that cartridges 20 are raised from cartridge tray 22 by weight sensor probes 112 on respective sensor assemblies 110 and are supported by probes 112. Cartridge tray 22 can be provided with openings at each cartridge location to permit probes 112 to pass through cartridge tray 22 and lift cartridges 20. Thus, each cartridge 20 can be weighed by one of the sensor cells 114 without interference from cartridge tray 22. In some embodiments, probe 112 includes a three-point support for cartridge 20. In other embodiments, probe 112 includes a cylindrical support for cartridge 20. Powder dispenser assembly 30 is lowered to a dispensing position. In the dispensing position, each powder dispenser module 54 is positioned slightly above and in alignment with one of the cartridges 20.

Figure 2:
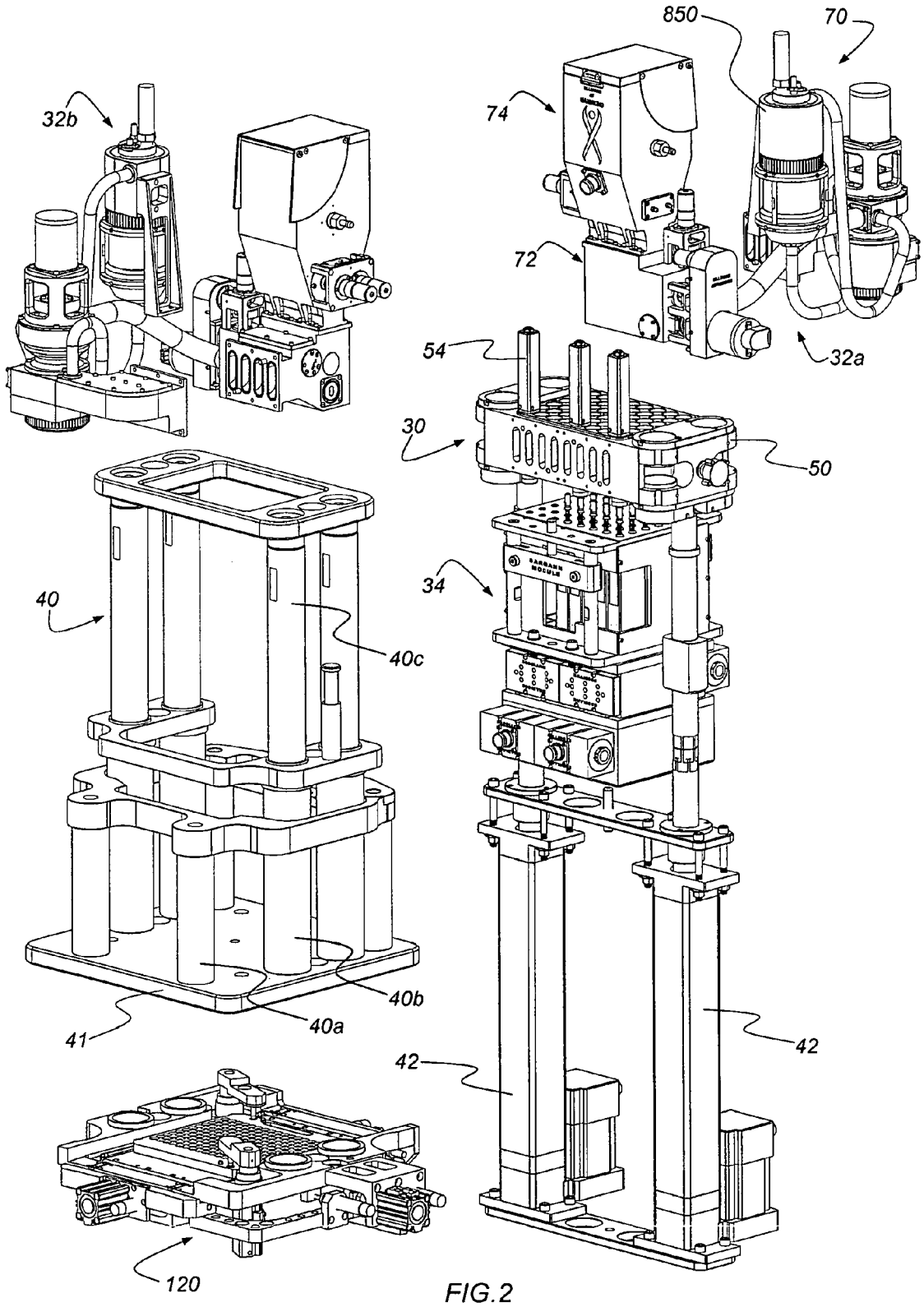
FIG. 2 is an exploded view of the powder dispensing and sensing apparatus of FIG. 1.
Figure 3:
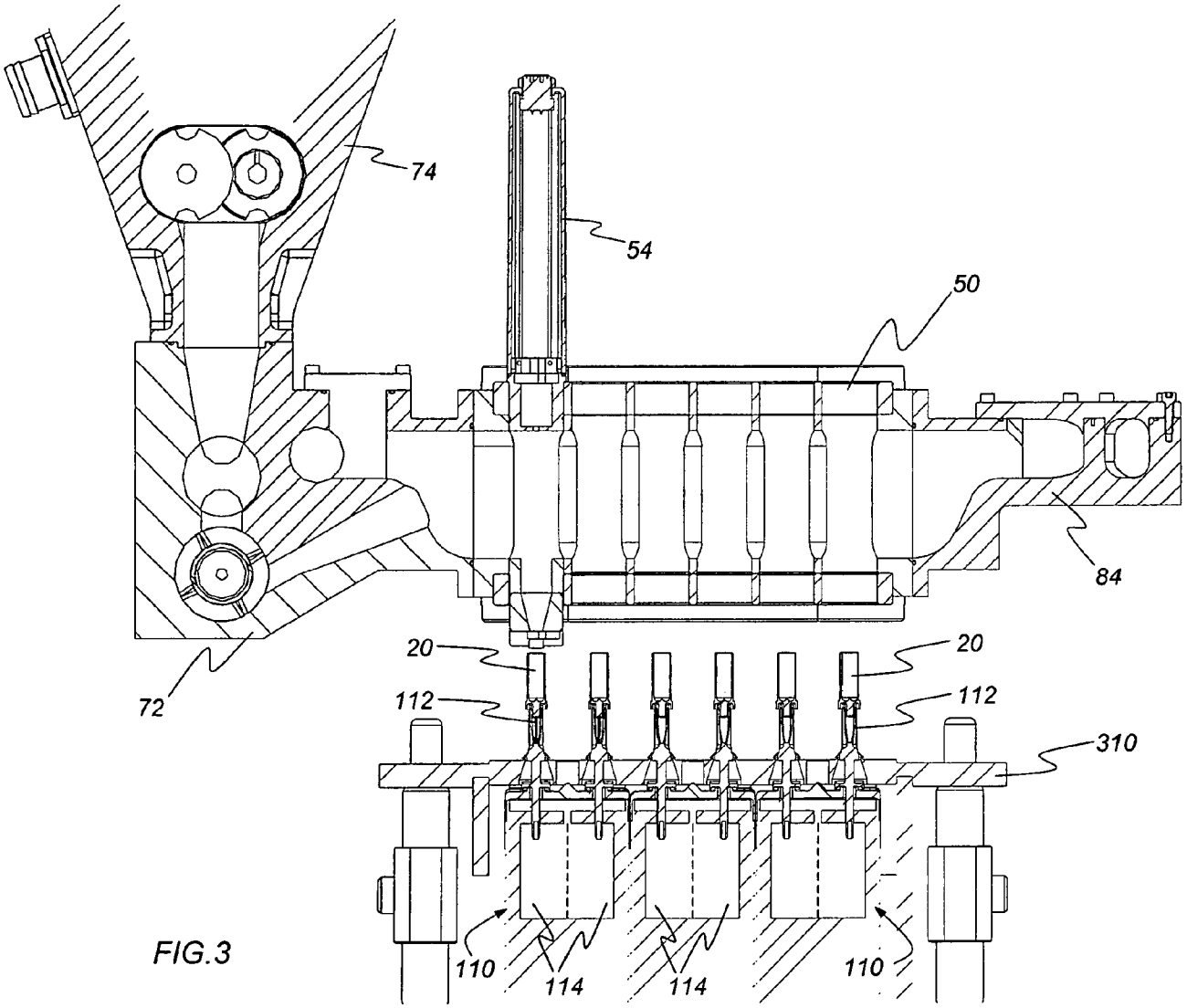
FIG. 3 is a partial vertical cross-sectional view of the powder dispensing and sensing apparatus.
Figure 3A:
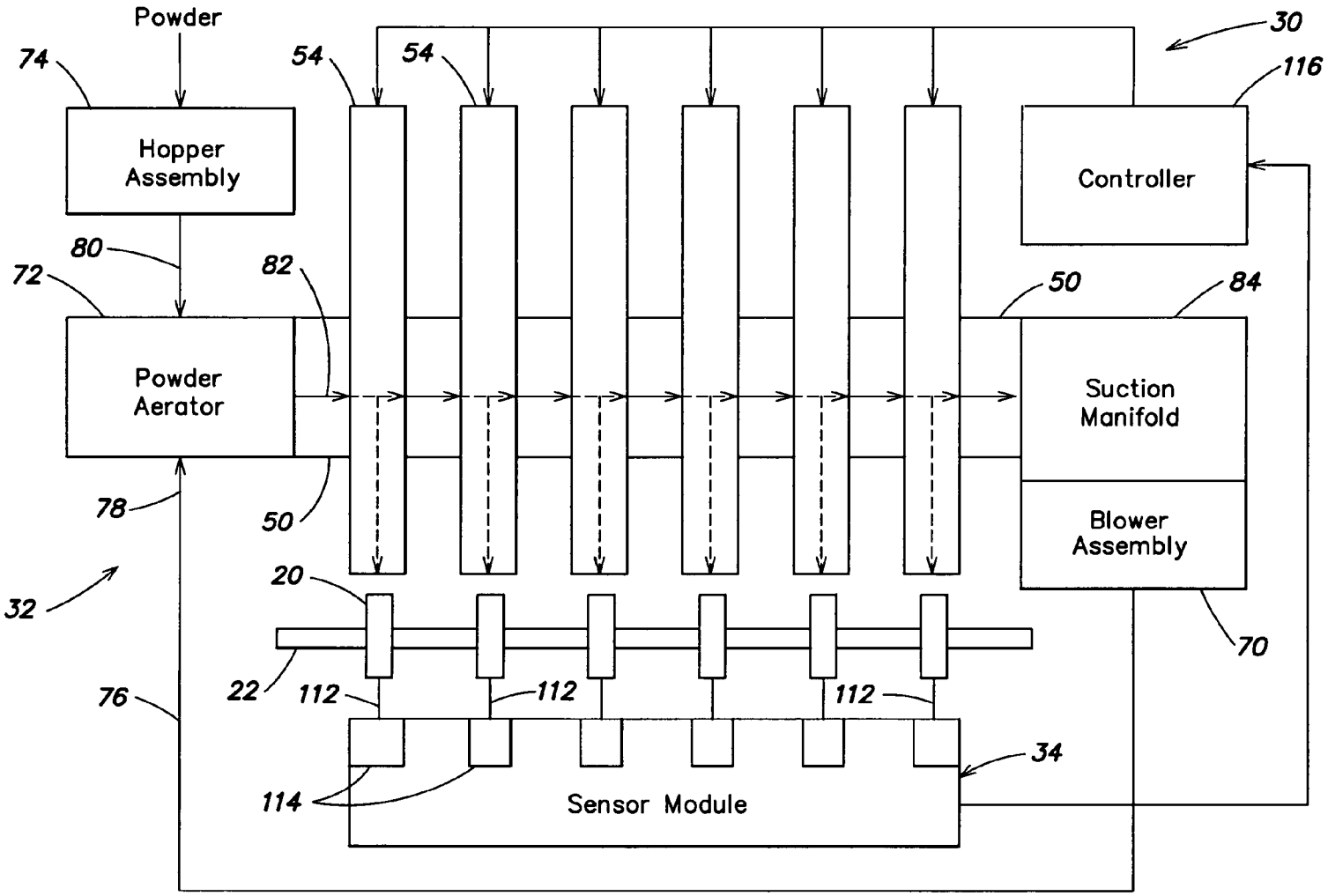
FIG. 3A is a schematic block diagram of the powder dispensing and sensing apparatus.
Figure 4:
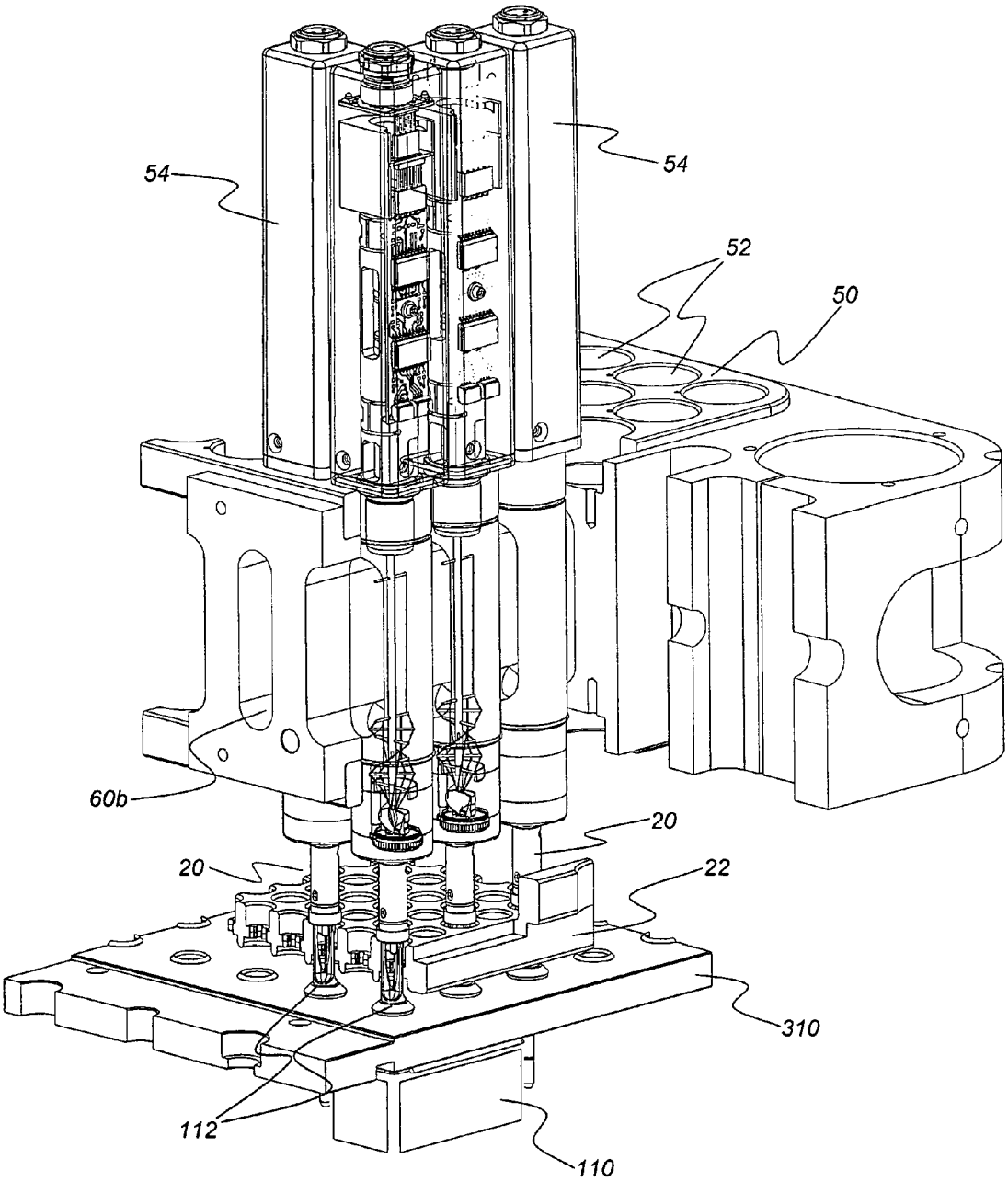
FIG. 4 is a perspective view of powder dispenser modules, cartridges, a cartridge tray and weight sensor cells.
Figure 5:
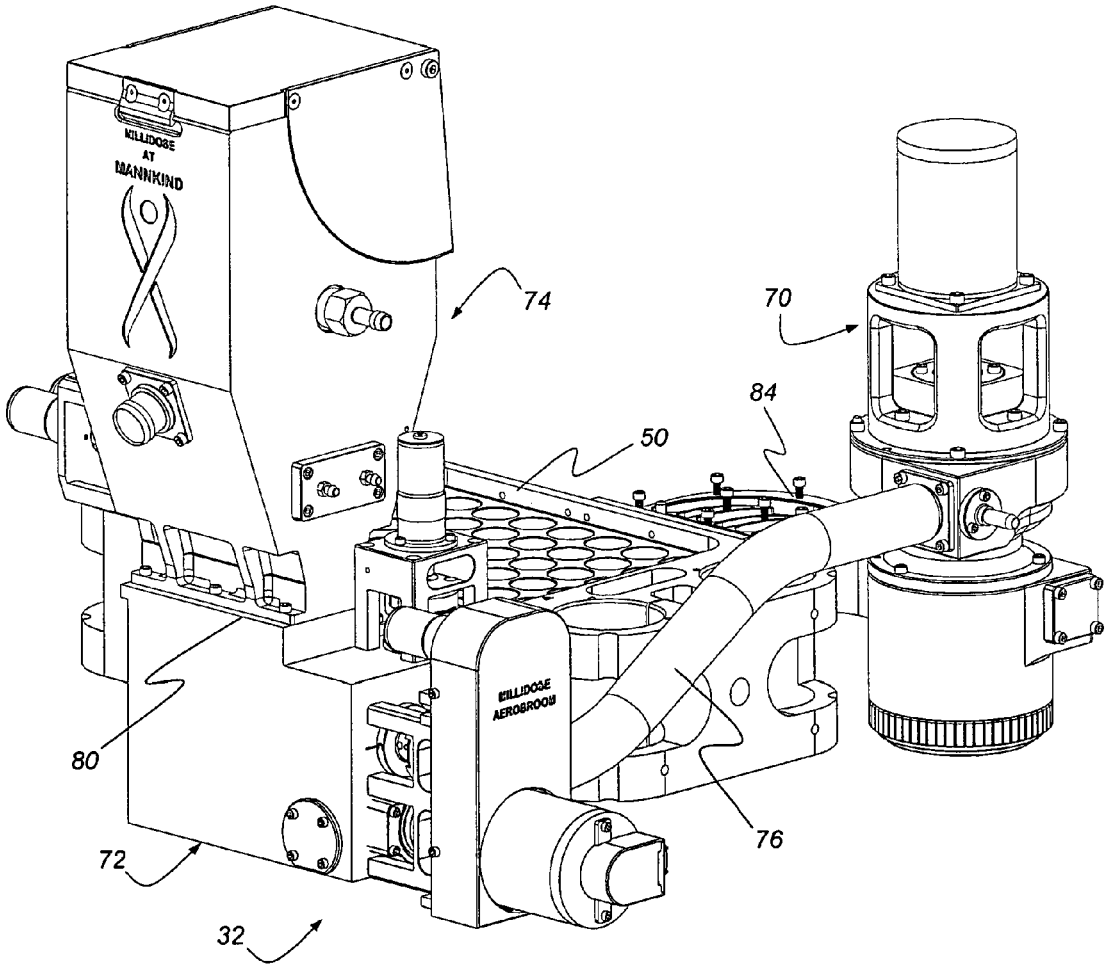
FIG. 5 is a perspective view of a powder transport system.
Figure 6:
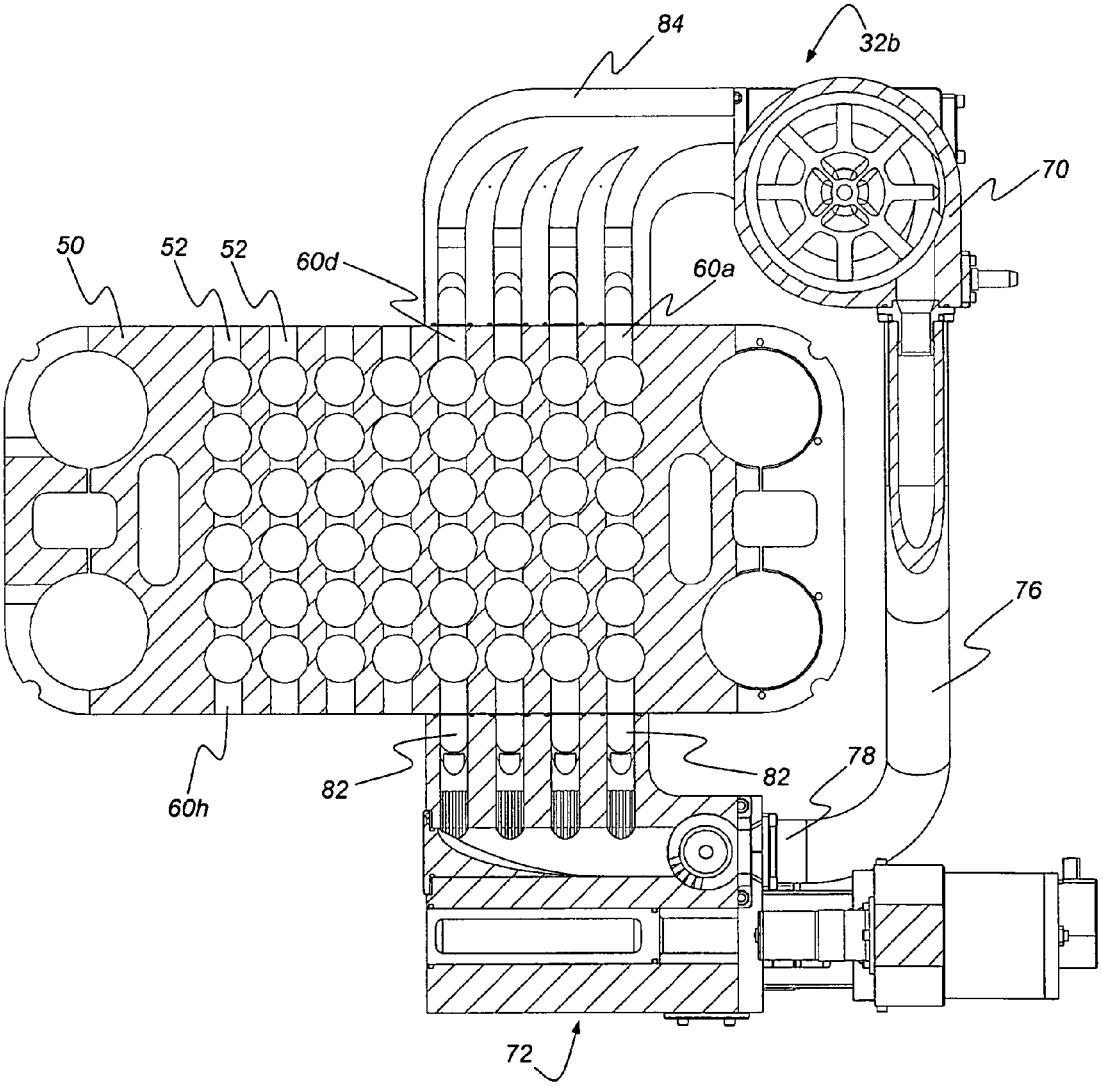
FIG. 6 is a cross-sectional diagram of an array block and one powder transport system.

As shown in FIG. 2, frame 40 can include a lower frame 40*a*, a middle frame 40*b* and an upper frame 40*c*. Lower frame 40*a* and middle frame 40*b* are secured to a base plate 41. Upper frame 40*c* provides mounting for tray support frame 24, powder dispenser assembly 30 and powder transport system 32. Array block 50 is connected to actuators 42 and moves upwardly or downwardly when actuators 42 are energized. Sensor module 34 is mounted in a fixed position within lower frame 40*a* and middle frame 40*b*.

Powder transport system 32 can operate continuously or at intervals. The powder dispenser modules 54 are activated to dispense powder to cartridges 20. The dispensing of powder to cartridges 20 is performed concurrently, so that all cartridges in cartridge tray 22 or a subset of the cartridges in the cartridge tray receive powder simultaneously. As powder dispensing progresses, the weights of cartridges 20 are sensed by respective sensor cells 114. The output of each sensor cell 114 is coupled to a controller. As discussed below, each controller compares the sensed weight with a target weight which corresponds to the desired quantity of powder. As long as the sensed weight is less than the target weight, powder dispensing continues. When the sensed weight is equal to or greater than the target weight, the controller commands the corresponding powder dispenser module 54 to terminate the powder dispensing operation. If the sensed weight exceeds a maximum allowable weight after the fill cycle, the corresponding cartridge can be marked as defective. Thus, powder dispensing and weight sensing proceed concurrently for a batch of cartridges in cartridge tray 22. The batch can include all the cartridges in cartridge tray 22 or a subset of the cartridges in the cartridge tray. A powder dispensing cycle can include concurrent dispensing of powder to and weight sensing of a batch of cartridges and achieves 100% inspection and control of powder dispensing.

In one embodiment, the number and spacing of cartridges in cartridge tray 22 matches the number and spacing of powder dispenser modules 54 in apparatus 10. In other embodiments, the cartridge tray can have a different number of cartridges and a spacing between cartridges that is different from the configuration of powder dispenser modules 54. For example, the cartridge tray can be configured to hold a multiple of the number of powder dispenser modules 54 and to have a smaller spacing between cartridges than the spacing between powder dispenser modules 54. By way of example only, the cartridge tray can be configured to hold 192 cartridges 20 spaced on one-half inch centers. With this arrangement, a 12×16 array of cartridges on one-half inch centers occupies the same area as a 6×8 array of cartridges on one inch centers.

Figure 7:
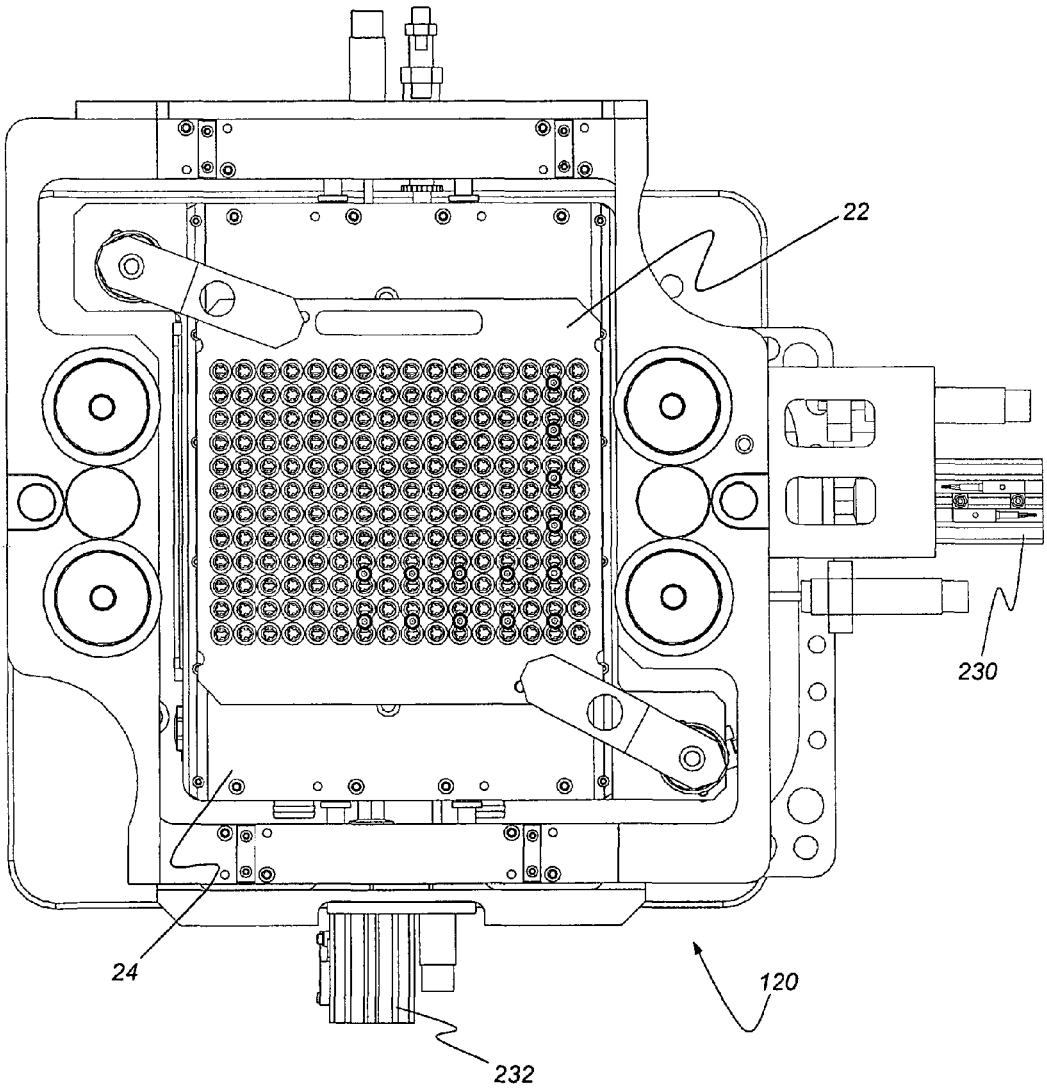
FIG. 7 is a cross-sectional diagram of a cartridge tray and a tray positioning system.

As shown in FIG. 7, the cartridge tray 22 can be displaced in a horizontal direction by a tray positioning mechanism 120 to align different batches of cartridges with powder dispenser modules 54. Cartridge tray 22 is positioned in tray support frame 24 for processing. Tray positioning mechanism 120 includes an X-direction actuator 230 coupled to tray support frame 24 and a Y-direction actuator 232 coupled to tray support frame 24. Thus, tray support frame 24 and cartridge tray 22 can be moved in a horizontal X-Y plane for positioning of batches of cartridges in relation to powder dispenser modules 54 and sensor cells 114.

The cartridge tray with 192 cartridges can be processed as follows. The cartridge tray is moved from a neutral position to a first X-Y position (0,0) such that a first batch of 48 cartridges is vertically aligned with the array of 48 powder dispenser modules 54. Powder is dispensed into the first batch of cartridges and then the cartridge tray is moved to a second X-Y position (0, 0.5) to align a second batch of 48 cartridges with the array of 48 powder dispenser modules 54. Powder is dispensed into the second batch of cartridges and then the cartridge tray is moved to a third X-Y position (0.5, 0) to align a third batch of 48 cartridges with the array of 48 powder dispenser modules 54. The cartridge tray is then moved to a fourth X-Y position (0.5, 0.5) to align a fourth batch of 48 cartridges with the array of 48 powder dispenser modules 54. Powder is dispensed into the fourth batch of cartridges to complete processing of the 192 cartridges. In the above example, the order of the tray positions and the order of the batches of cartridges can be changed.

It will be understood that this process can be applied to different tray arrangements with a different spacing between cartridges, different numbers of cartridges, and the like. In these embodiments, the cartridge tray is displaced in the horizontal plane to achieve alignment between batches of cartridges and the array of powder dispenser modules. The batch of cartridges typically matches the array of powder dispenser modules 54. However, in some applications the batch can have fewer cartridges than the number of powder dispenser modules.

Additional details regarding the powder dispensing and sensing apparatus 10 are described in International Publication No. WO 2007/061987, published 31 May 2007, which is hereby incorporated by reference.

Embodiments of powder dispenser module 54 are shown in FIGS. 8-17 and are described below.

Powder dispenser module 54 includes a powder dispenser housing 150 having a lower housing section 150*a*, a middle housing section 150*b*, an upper housing section 150*c* and a cover 150*d*. The powder dispenser housing 150 can have an elongated configuration with a small cross section to permit close spacing in array block 50. As noted above, powder dispenser modules 54 can be mounted on one inch centers. Middle housing section 150*b* includes powder inlet 130 and a cylindrical conduit that extends downwardly from powder inlet 130 to lower housing section 150*a*. Lower housing section 150*a* includes a tapered conduit that extends downwardly to a dispenser nozzle 158, which is dimensioned for compatibility with cartridge 20. The cylindrical conduit and the tapered conduit may be considered to form a powder chamber of the powder dispensing module 54. Dispenser nozzle 158 is configured to dispense powder into cartridge 20. The cover 150*d* can be an aluminum cover which is painted black inside to facilitate heat transfer out of the dispenser electronics and to permit the powder dispenser module to be waterproofed.

Powder dispenser module 54 further includes a feed wand assembly 160 to move powder downwardly in a controlled manner through the dispenser to nozzle 158, and a dispenser fill valve 180 at the lower end of the tapered conduit in lower housing section 150*a*. Powder dispenser module 54 further includes a circuit board 184 having circuitry for controlling feed wand assembly 160 and fill valve 180, and for communicating with control circuitry that controls operation of powder dispenser module 54.

Figure 10:
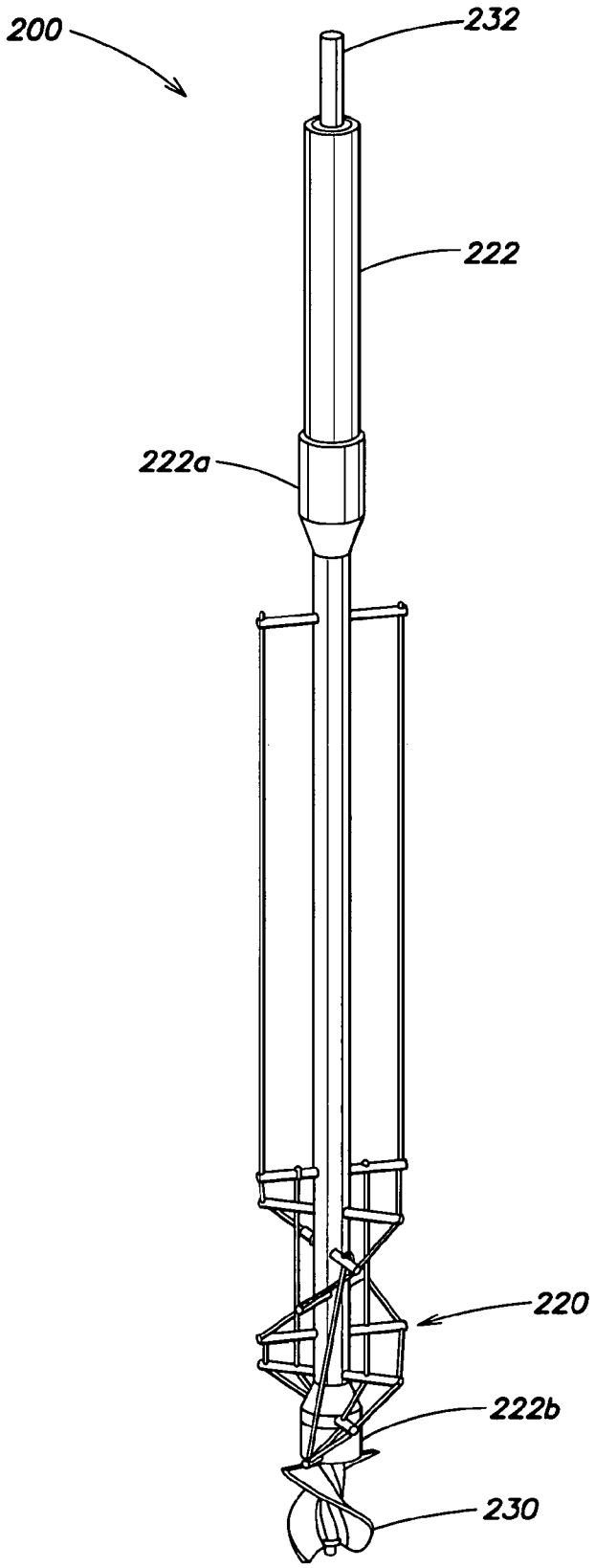
FIG. 10 illustrates a feed wand used in the powder dispenser module of FIG. 8.
Figure 11:
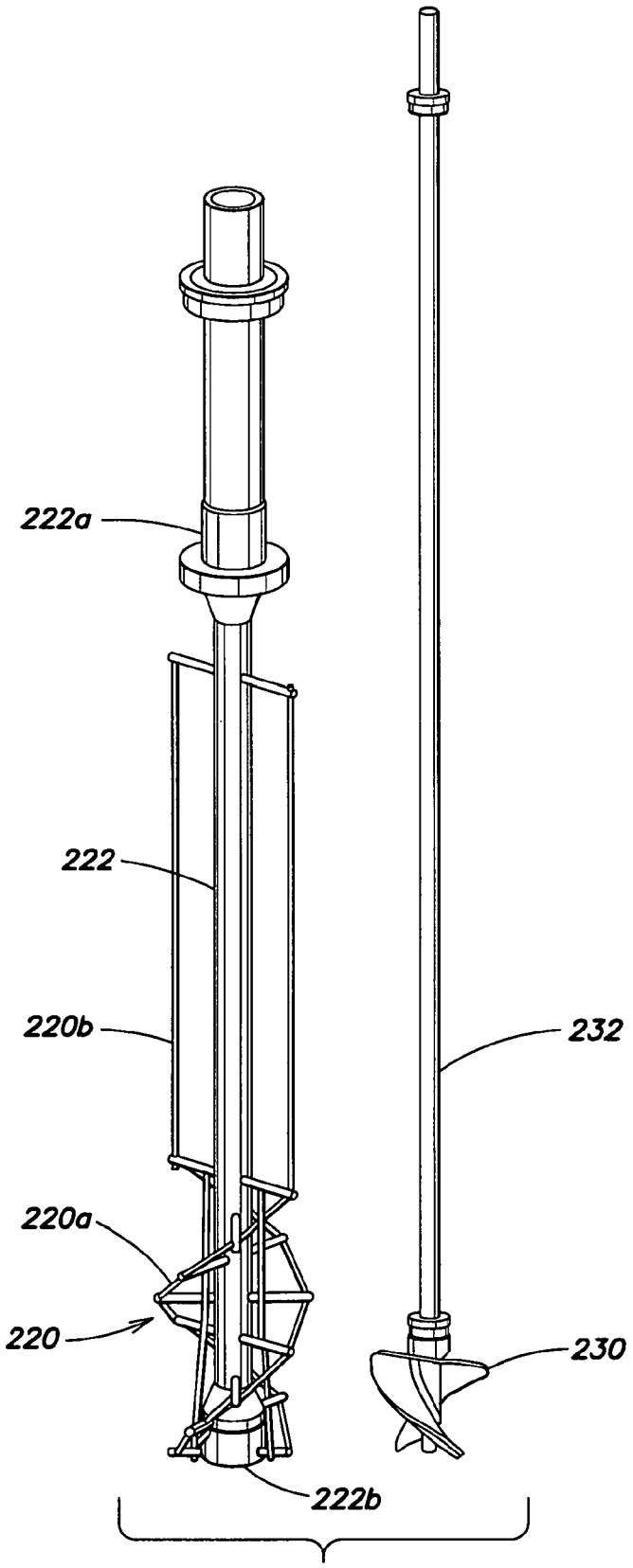
FIG. 11 is an exploded view of the feed wand of FIG. 10.
Figure 12:
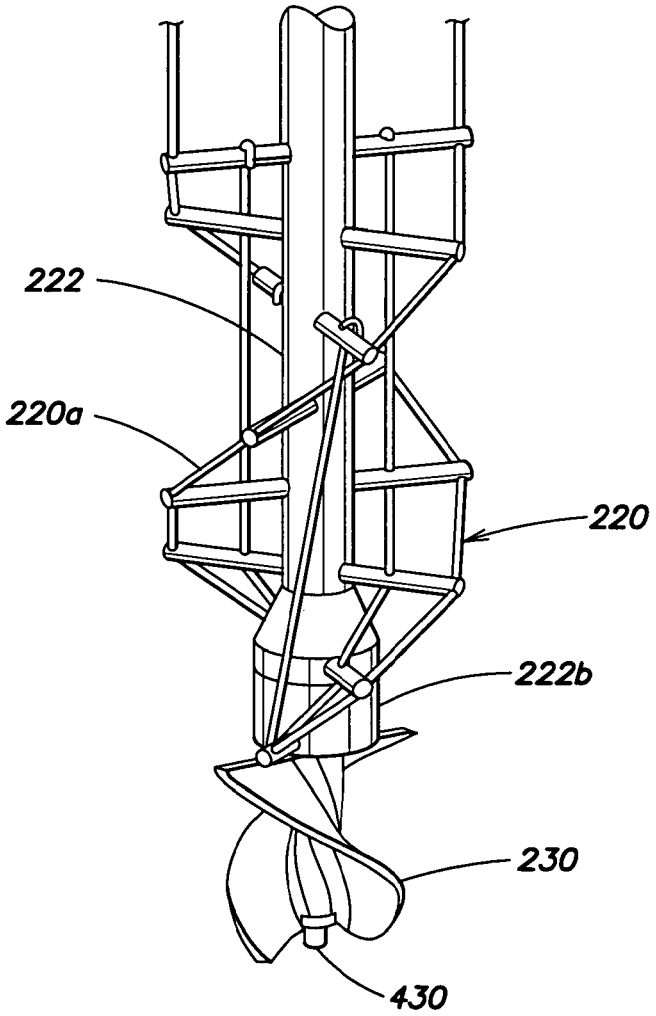
FIG. 12 is an enlarged view of the lower end of the feed wand of FIG. 10.
Figure 13:
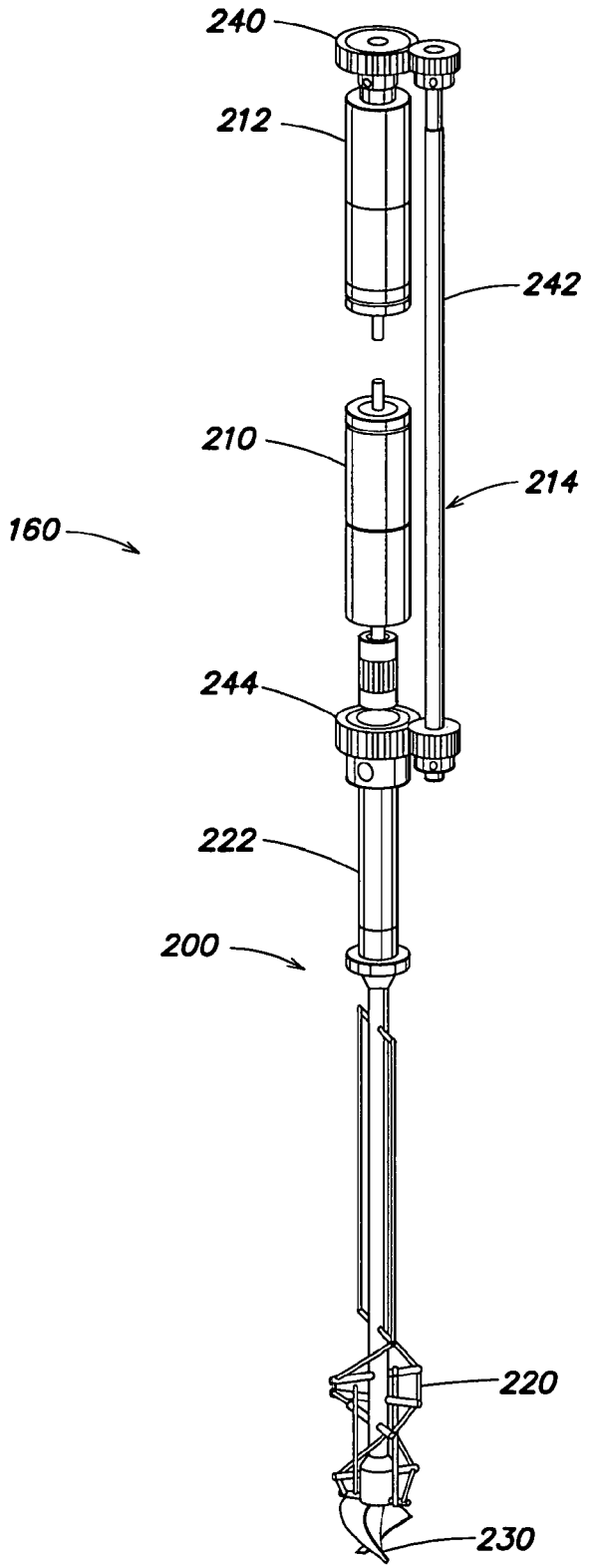
FIG. 13 illustrates a feed wand assembly including the feed wand and associated drive components.

Details of feed wand assembly 160 are shown in FIGS. 10-13. Referring to FIG. 13, feed wand assembly 160 includes a feed wand 200, a first actuator 210, a second actuator 212 and an actuator coupling 214. Referring to FIGS. 10-12, feed wand 200 includes an upper feed element 220 affixed to an outer shaft 222 and a lower feed element 230 affixed to an inner shaft 232. The outer shaft 222 may have a central bore extending through its length, and inner shaft 232 may be concentrically mounted in the bore through outer shaft 222. Further, inner shaft 232 may be free to rotate within outer shaft 222.

Ball bearings and drive shaft seals (not shown) are pressed in both flanged ends 222*a* and 222*b* of the cylindrical outer shaft 222. The ball bearings insure long life and easy rotation of the coaxial inner shaft 232, and the seals prevent powder ingress, thus insuring long life of the bearings and preventing the drive shaft from jamming, as well as making the system GMP compliant. This is because the seals prevent the powder from accumulating between the drive shafts and thus do not promote bacterial growth. The sealed system is easy to clean, as the entire dispenser module can be submerged in an ultrasonic bath for cleaning.

In some embodiments, upper feed element 220 may be a wire frame structure including a helical portion 220*a* and a straight portion 220*b* located above helical portion 220*a*. Lower feed element 230 may be an auger. In the feed wand 220 of FIGS. 10-12, upper feed element 220 and lower feed element 230 may rotate in the same direction or in opposite directions, and may rotate at the same speed or at different speeds. Thus, upper feed element 220 and lower feed element 230 may be independently controlled to achieve a desired powder feed operation.

As shown in FIG. 13, first actuator 210 is coupled to inner shaft 232 for rotation of lower feed element 230. Second actuator 212 is coupled via actuator coupling 214 to outer shaft 222 for rotation of upper feed element 220. Actuator coupling 214 may include an upper gear set 240 mounted to second actuator 212, a coupling rod 242 and a lower gear set 244 mounted to outer shaft 222. First actuator 210 and second actuator 212 may be miniature motors which can be controlled to independently rotate lower feed element 230 and upper feed element 220, respectively.

Figure 14A:
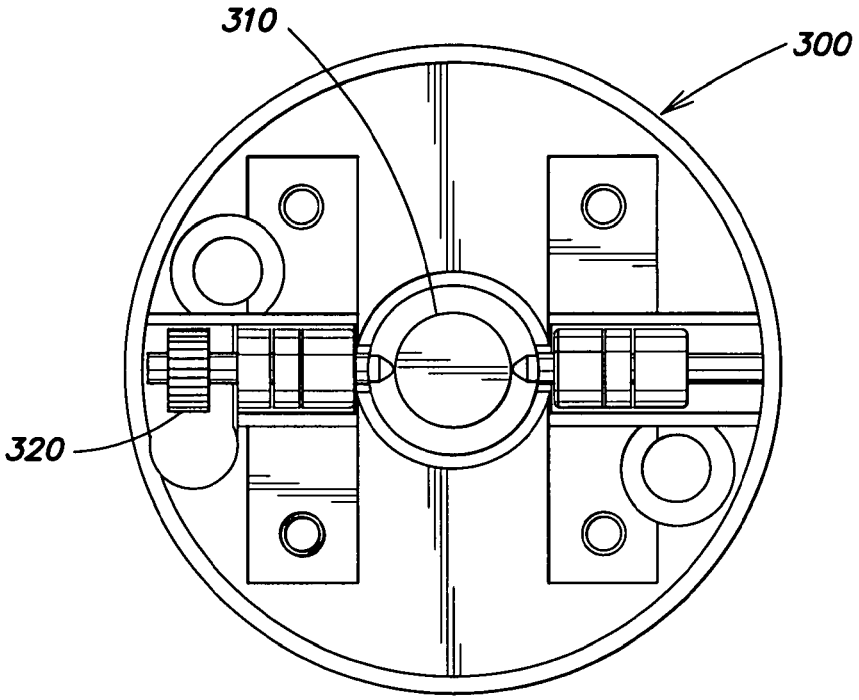
FIG. 14A is a bottom view of the powder dispenser module, showing a fill valve in accordance with embodiments of the invention.
Figure 14B:
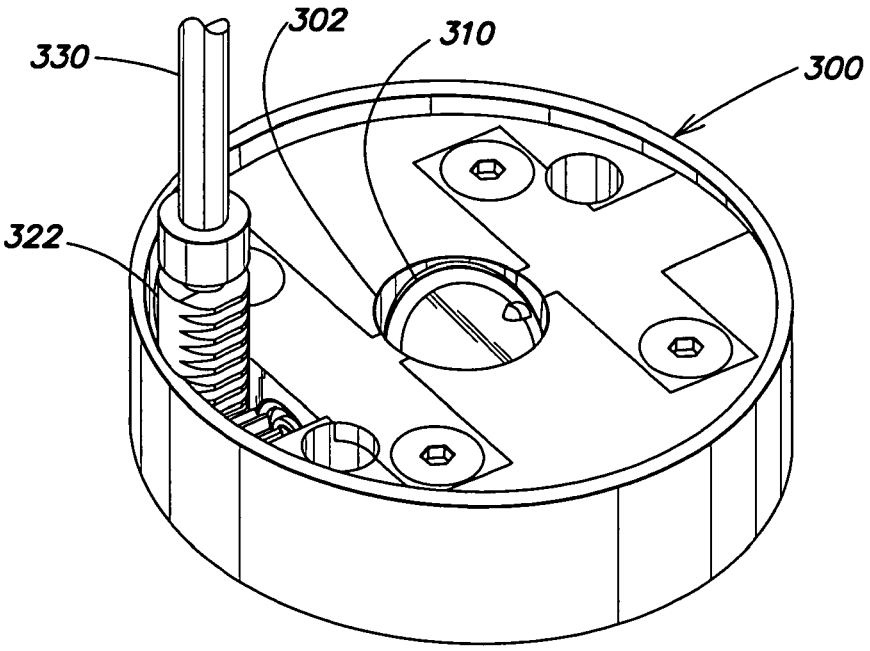
FIG. 14B is a perspective view of the fill valve of FIG. 14A.
Figure 15:
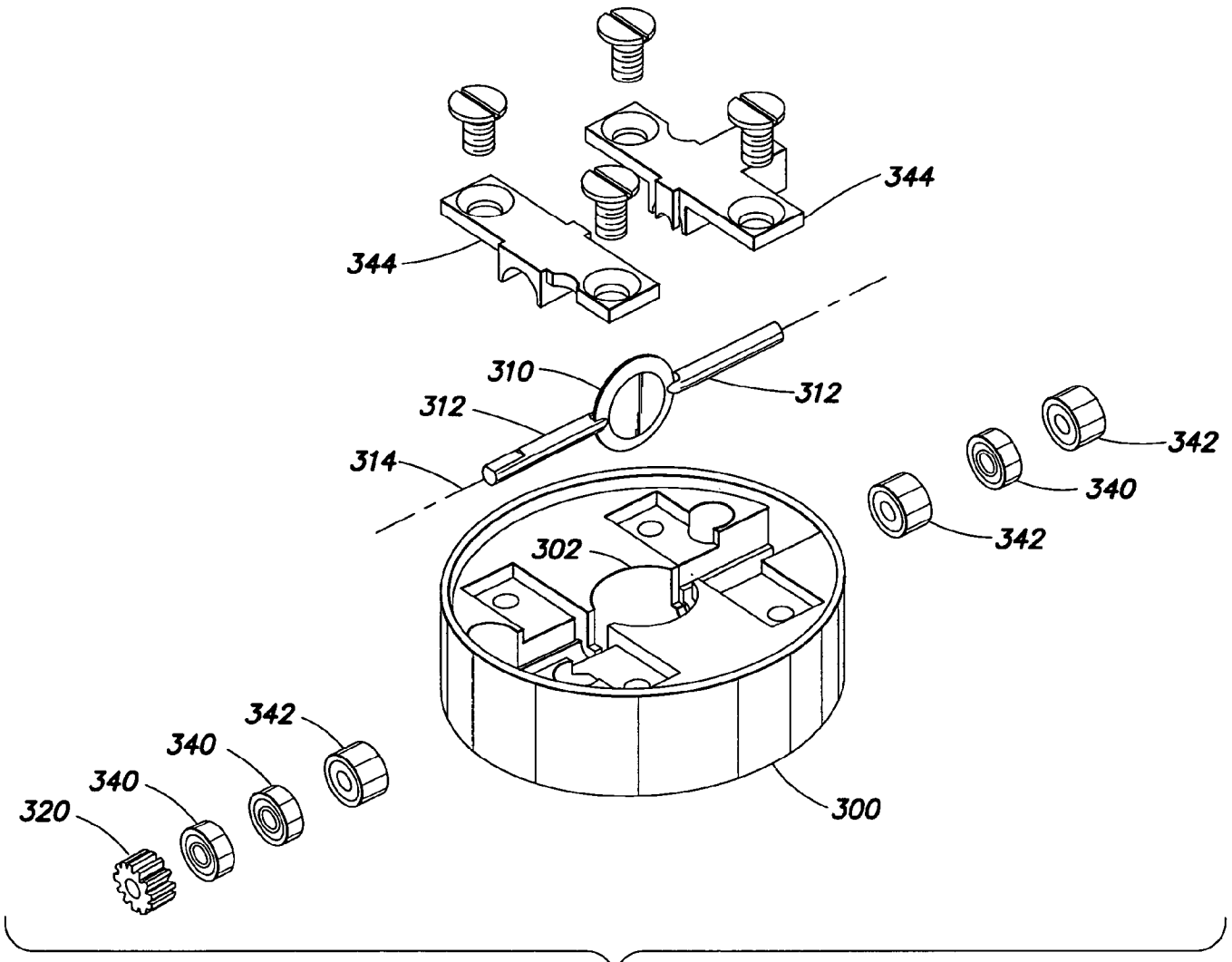
FIG. 15 is an exploded view of the fill valve of FIG. 14A.

Details of fill valve 180 are shown in FIGS. 14A, 14B and 15. Fill valve 180 is configured as a butterfly valve that is actuated between open and closed positions by a rack and pinion arrangement. Fill valve 180 includes a valve housing 300 having a cylindrical passage 302 that defines dispenser nozzle 158. A valve member 310 is positioned within cylindrical passage 302 and is connected to a valve shaft 312 which is rotatable about an axis 314, so that valve member 310 is rotated between open and closed positions. A pinion gear 320 is mounted to shaft 312, and a rack 322 (FIG. 14B) engages pinion gear 320.

Figure 9:
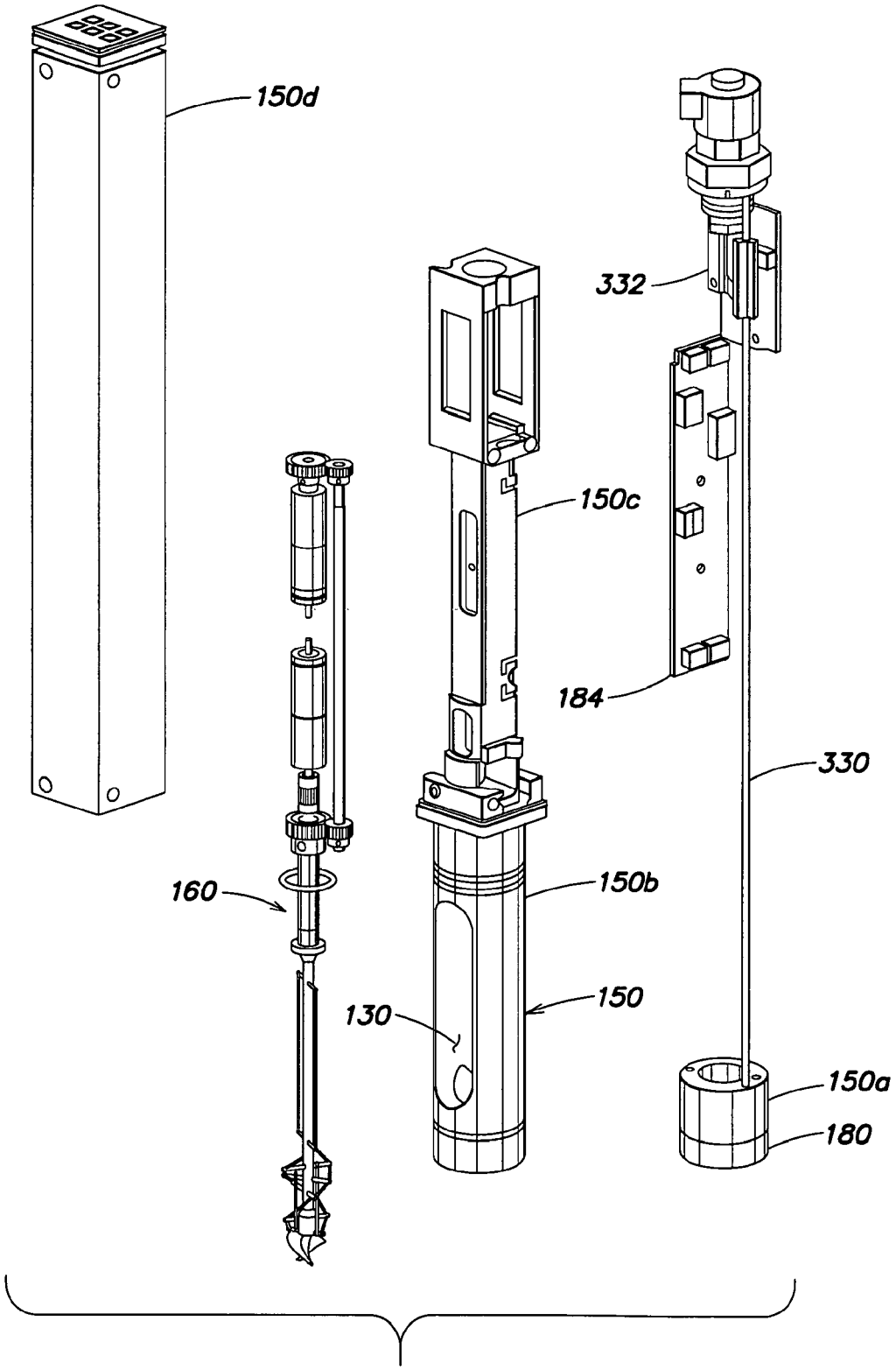
FIG. 9 is an exploded view of the powder dispenser module of FIG. 8.

A drive shaft 330 is connected between rack 322 and a valve actuator 332, shown in FIG. 9. Valve actuator 332 is mounted near the top of powder dispenser module 54 and produces linear motion of drive shaft 330, which is converted by rack 322 and pinion gear 320 to rotating movement of valve member 310 between open and closed positions. Valve actuator 332 may be a linear solenoid. As shown in FIG. 15, fill valve 180 further includes bearings 340, seals 342 and bearing covers 344.

A gasket may be mounted between the valve housing 300 and the lower housing section 150*a* of the powder dispenser module. The gasket prevents powder from migrating into the valve drive mechanism. The valve member 310 is configured as a disk which rotates 90° between open and closed positions. The edges of the disk are relatively sharp, so that there is no edge for powder to rest on and to fall into cartridges at random times. Such randomly falling powder causes undesirable fill variations. The valve shaft has bearings and seals at both ends to enable easy rotation and to prevent powder ingress. Since the valve drive uses a simple vertical motion, the valve can be closed in 100 to 200 milliseconds, thus overcoming the problem of powder dispensing after the fill command has ended.

Figure 16A:
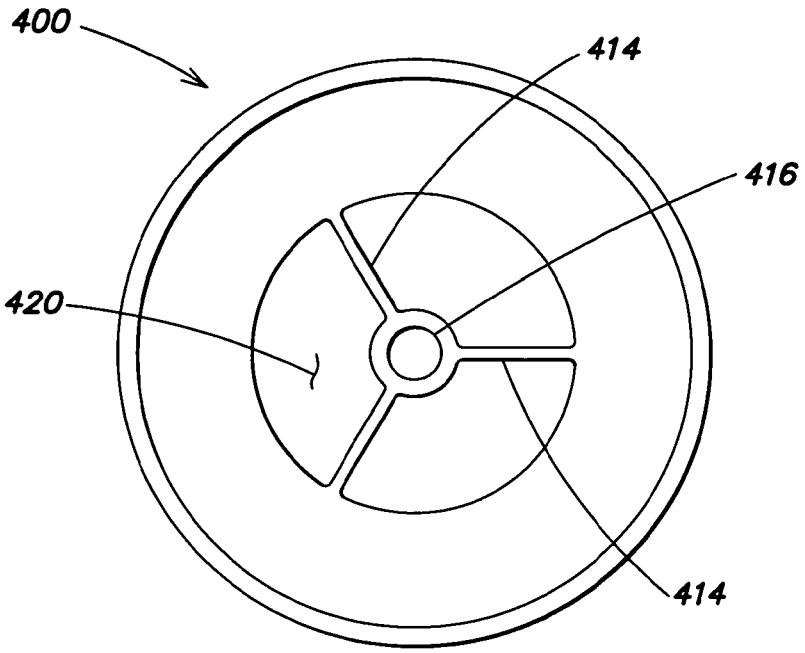
FIG. 16A is a top view of a three-spoke granulator in accordance with embodiments of the invention.
Figure 16B:
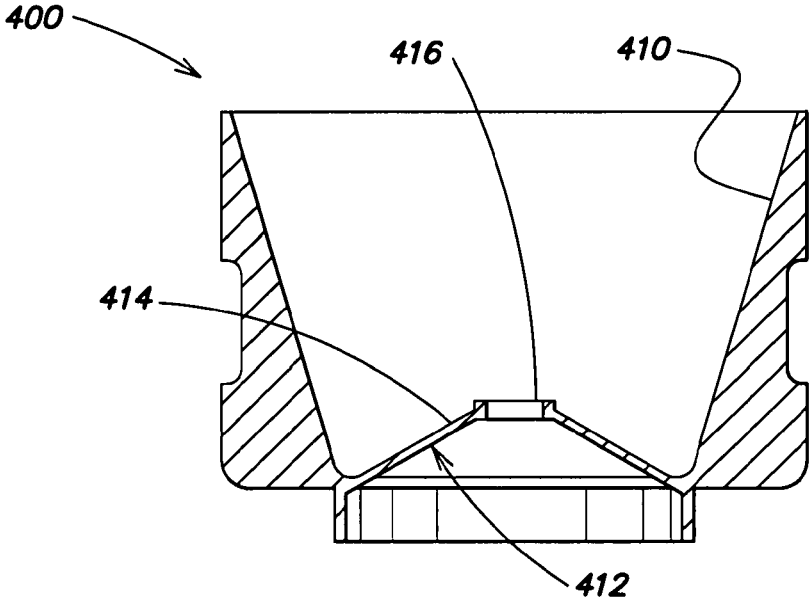
FIG. 16B is a cross-sectional view of the three-spoke granulator of FIG. 16A.

The powder dispenser module 54 further includes a granulator 400 shown in FIGS. 16A and 16B. The granulator 400 is mounted in the lower housing section 150*a* above fill valve 180 and has an inside wall 410 that is tapered from larger diameter at the top to smaller diameter at the bottom. An orifice element 412 has an inverted conical shape and is configured, in this embodiment, with three radial spokes 414 which support a ring 416. The spokes define three orifices 420 for discharge of powder through nozzle 158. The lower edges of the lower feed element 230, typically in the form of an auger, are angled to match the inverted conical orifice element 412. A bearing 430 (FIG. 12) mounted at the lower end of inner shaft 232 engages ring 416 and establishes a desired spacing between lower feed element 230 and orifice element 412. In operation, lower feed element 230 rotates relative to orifice element 412, causing powder to be discharged through the orifices 420 in orifice element 412.

The granulator 400 is mounted above the fill valve 180 and provides rotational support for the lower feed element 230. The lower feed element 230 rests on a sapphire bearing which is mounted in the ring 416 at the center of the granulator 400. The granulator 400 is configured to minimize restriction on powder flow. In other embodiments, the granulator may have any number of spokes or may be provided with a pattern of holes, with the parameters of the granulator selected based on the powder being dispensed.

Figure 17:
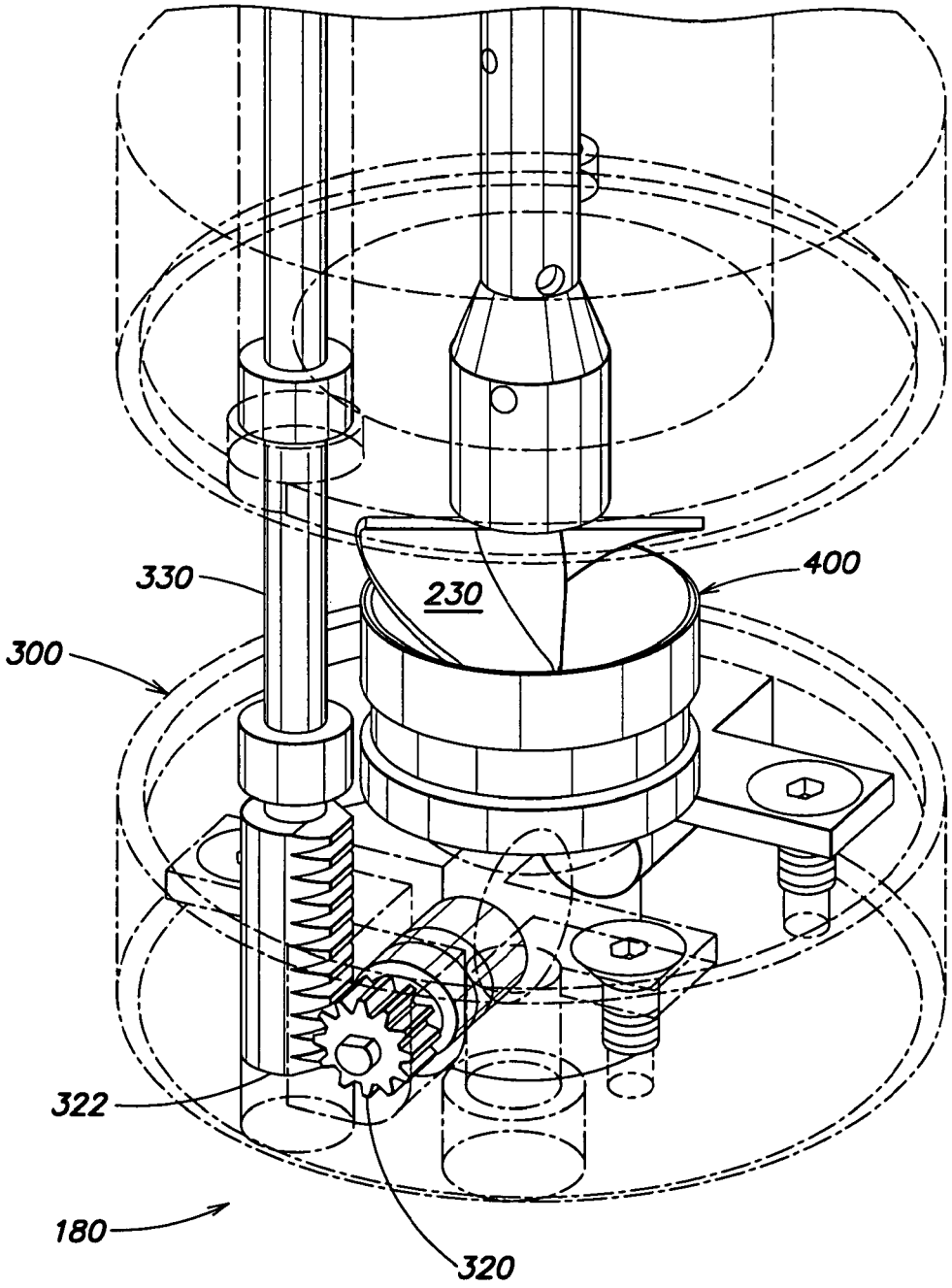
FIG. 17 is an enlarged perspective view of the lower end of the powder dispenser module of FIGS. 8 and 9, with some elements omitted and some elements shown as transparent for purposes of illustration.

FIG. 17 is an enlarged perspective view of the lower end of the powder dispenser module of FIGS. 8 and 9, with some elements omitted and some elements transparent for purposes of illustration. FIG. 17 illustrates the interrelationship of lower feed element 230, granulator 400 and fill valve 180 in the powder dispenser module. In some embodiments, the powder dispenser module can be made GMP compliant by making all parts of the powder dispenser module water-tight.

As discussed above, the powder dispenser module 54 has a cylindrical conduit with a tapered lower section which terminates in the dispenser nozzle. The tapered surface exerts on the powder particles a net upward force which opposes the downward force that is applied to deliver powder through the nozzle. The powder dispenser module shown in FIGS. 8-17 and described above is configured to enhance powder delivery, to reduce powder delivery time and to increase powder delivery accuracy.

As described above, the feed wand assembly 160 is configured with separate drive shafts and actuators for the upper feed element 220 and the lower feed element 230. By separating the upper feed element and the lower feed element and driving them independently, the upper feed element 220 can rotate continuously with the fill valve closed. This keeps the powder fluidized and thus ready for dispensing. At the same time, the lower feed element 230 is not rotated, so that the powder between the lower feed element 230 and the fill valve is not compressed. When the powder dispenser module is commanded to dispense powder, the fill valve is opened and the lower feed element 230 is rotated a few revolutions by the first actuator 210.

The feed wand assembly 160 with separate drive shafts and actuators for the upper and lower feed elements can rotate the upper and lower feed elements in the same or opposite directions and can rotate the upper and lower feed elements at the same or different speeds. Further, one of the feed elements can rotate while the other feed element is held stationary. Thus, the upper and lower feed elements operate independently.

In the powder dispenser module 54, circuit board 184 may include an embedded processor and motor control electronics. The processor runs a real time preemptive operating system which communicates with its corresponding sensor cell 114 and with the components of the powder dispenser module to control the powder dispenser module.

As described above, the upper feed element 220 can run continuously to keep the powder fluidized in the powder dispenser module. To dispense a required weight of powder, the fill valve is opened and rotation of lower feed element 230 is started for a predetermined time. The powder dispenser module interrogates the sensor cell at fixed time intervals, approximately every 200 milliseconds, and determines a fill rate under the current powder dispensing conditions. Based on the fill rate, the processor modifies the predetermined dispensing time. Since each powder dispensing module communicates directly with its sensor cell, the communications time latency is fixed and a deterministic fill rate is obtained. The powder dispenser module terminates dispensing at the end of the adaptively determined fill time, and the fill valve closes rapidly, preventing overshoot in the weight of the powder dispensed.

The embodiment of the powder dispensing and sensing apparatus 10 shown in FIGS. 1-7 and described above utilizes a two-dimensional array of powder dispensing modules mounted in an array block 50. In one embodiment, the array block 50 has a 6×8 array of ports for mounting 48powder dispenser modules. In some embodiments, it may be desirable to utilize an array of powder dispenser modules having a single row of powder dispenser modules or a few rows of powder dispenser modules, as shown in FIGS. 18-22 and described below.

Figure 18:
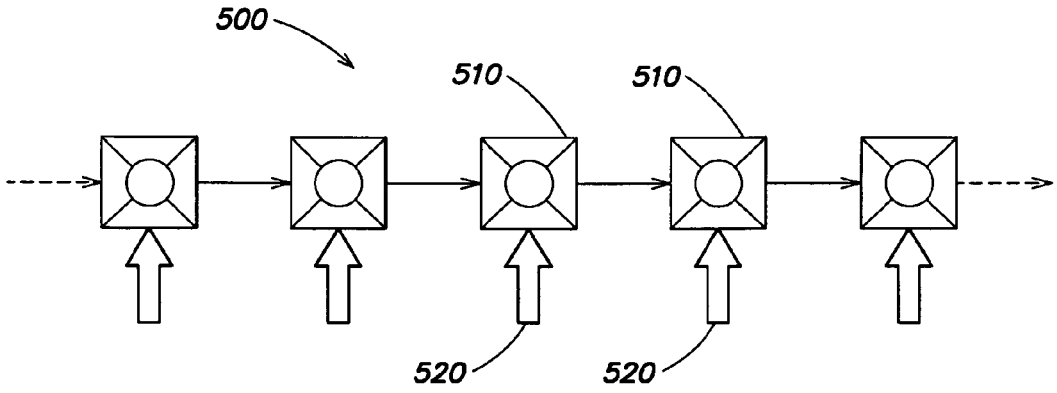
FIG. 18 is a schematic plan view of an array of powder dispenser modules in accordance with embodiments of the invention.

An array 500 of powder dispenser modules 510 is shown in FIG. 18. The array 500 includes a single row of powder dispenser modules 510. In the array 500, each of powder dispenser modules 510 receives powder feed 520 on the same side. The array 500 can have any desired number of powder dispenser modules 510. By providing direct powder feeds to each powder dispenser module 510, the powder feed mechanism may be simplified. Rows of cartridges to be filled can be indexed into alignment with the array 500 of powder dispenser modules 510 for filling.

Figure 19:
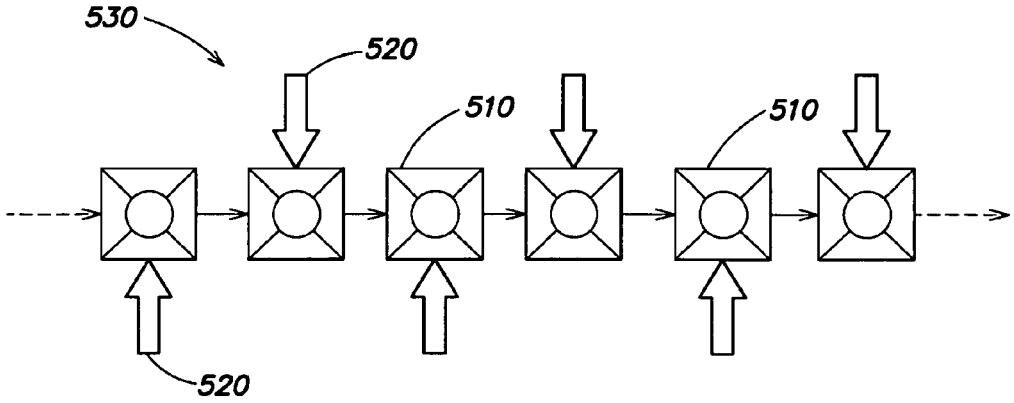
FIG. 19 is a schematic plan view of an array of powder dispenser modules in accordance with embodiments of the invention.

An array 530 of powder dispenser modules 510 is shown in FIG. 19. The array 530 also includes a single row of powder dispenser modules. The array 530 differs from the array 500 of FIG. 18 in that alternate powder dispenser modules 510 receive powder feed 520 from opposite sides. This configuration has an advantage that more space is available for the powder feed mechanism on both sides of array 530.

Figure 20:
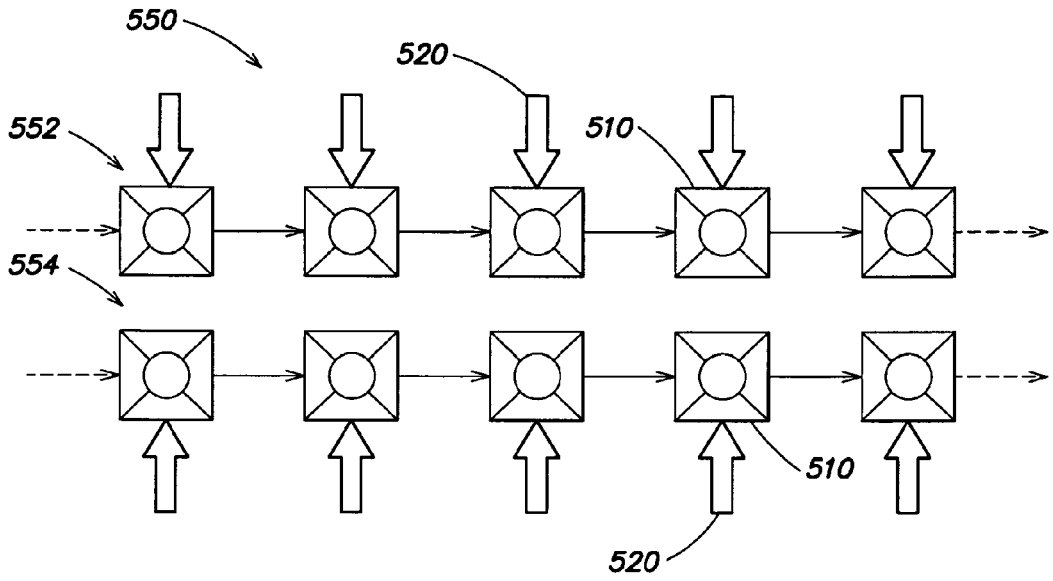
FIG. 20 is a schematic plan view of an array of powder dispenser modules in accordance with embodiments of the invention.

An array 550 including a first row 552 and a second row 554 of powder dispenser modules 510 is shown in FIG. 20. First row 552 receives powder feed 520 from one side, and second row 554 receives powder feed 520 from the opposite side. The array 550 has the advantage of increased powder filling capacity while permitting direct powder feed to each powder dispenser module 510. Each of rows 552 and 554 can include any number of powder dispenser modules 510.

Figure 21:
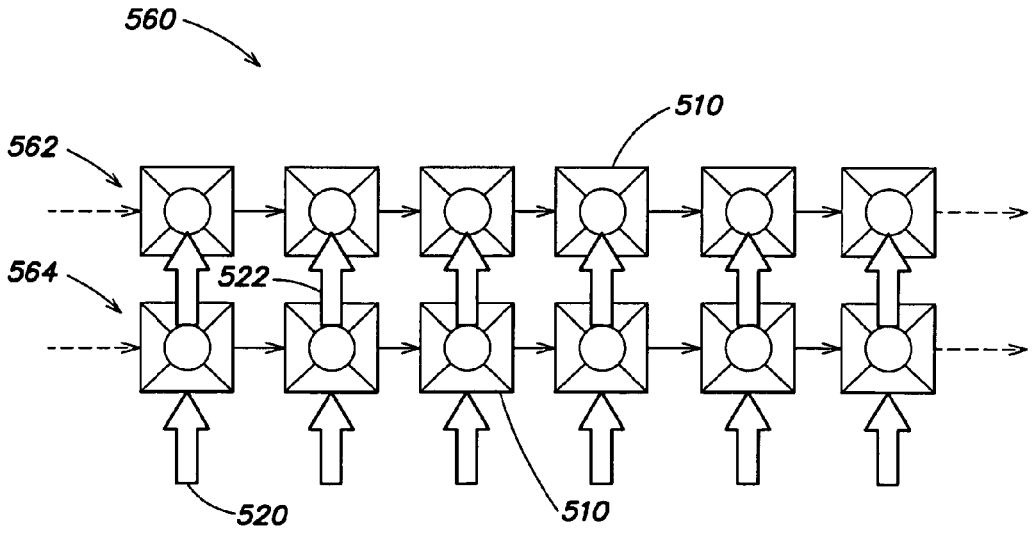
FIG. 21 is a schematic plan view of an array of powder dispenser modules in accordance with embodiments of the invention.

An array 560 including a first row 562 and a second row 564 of powder dispenser modules 510 is shown in FIG. 21. In the array 560, powder feed 520 is supplied to second row 554 from one side of array 560, and powder feed 522 is supplied to first row 562 of powder dispenser modules 510 from the powder dispenser modules 510 of second row 564 in a feedthrough manner. An advantage of the array 560 is that powder is supplied to the array from one side, while two rows of powder dispenser modules 510 are used for filling of cartridges at the same time.

Figure 22:
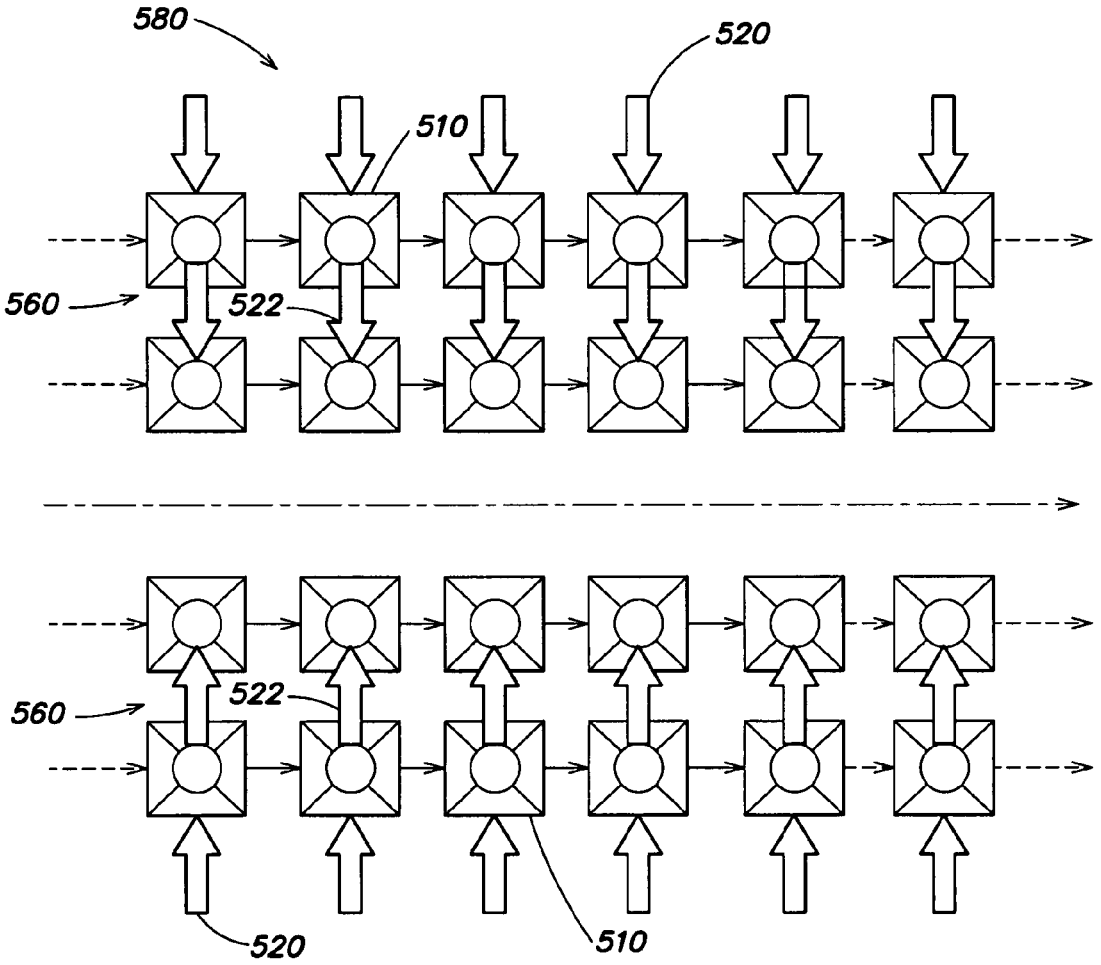
FIG. 22 is a schematic plan view of an array of powder dispenser modules in accordance with embodiments of the invention.

An array 580 of powder dispenser modules 510 is shown in FIG. 22. Array 580 is essentially a repetition of array 560 shown in FIG. 21 and described above, except that upper array 560 receives powder feed 520 from one side and lower array 560 receives powder feed 520 from the opposite side. The array 580 of FIG. 21 has an advantage that a larger number of cartridges can be filled simultaneously, but has the disadvantage that powder feed 520 is more complex than for a single array.

Figure 23:
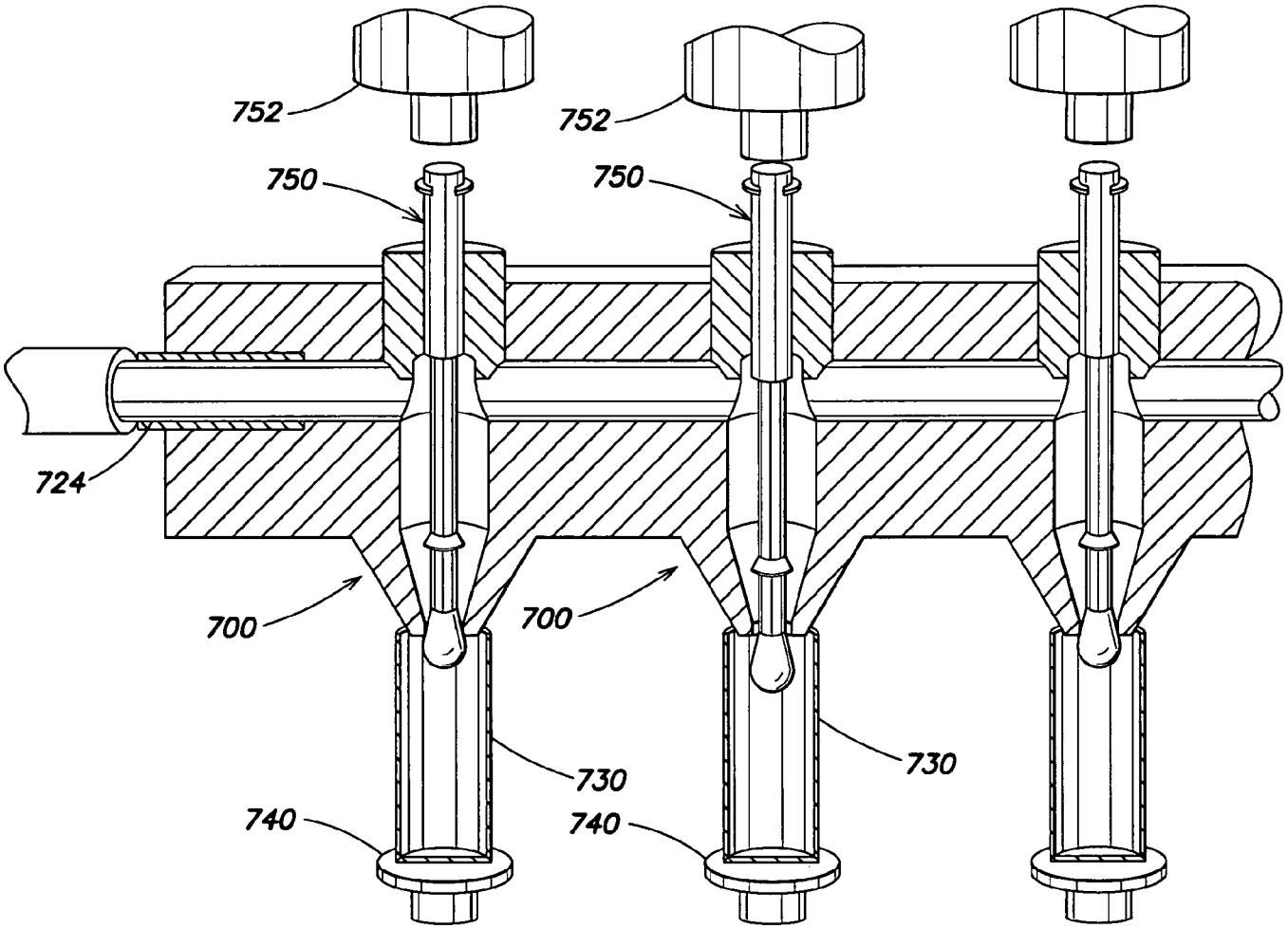
FIG. 23 is a schematic, cross-sectional view of an array of powder dispenser modules in accordance with embodiments of the invention.
Figure 24:
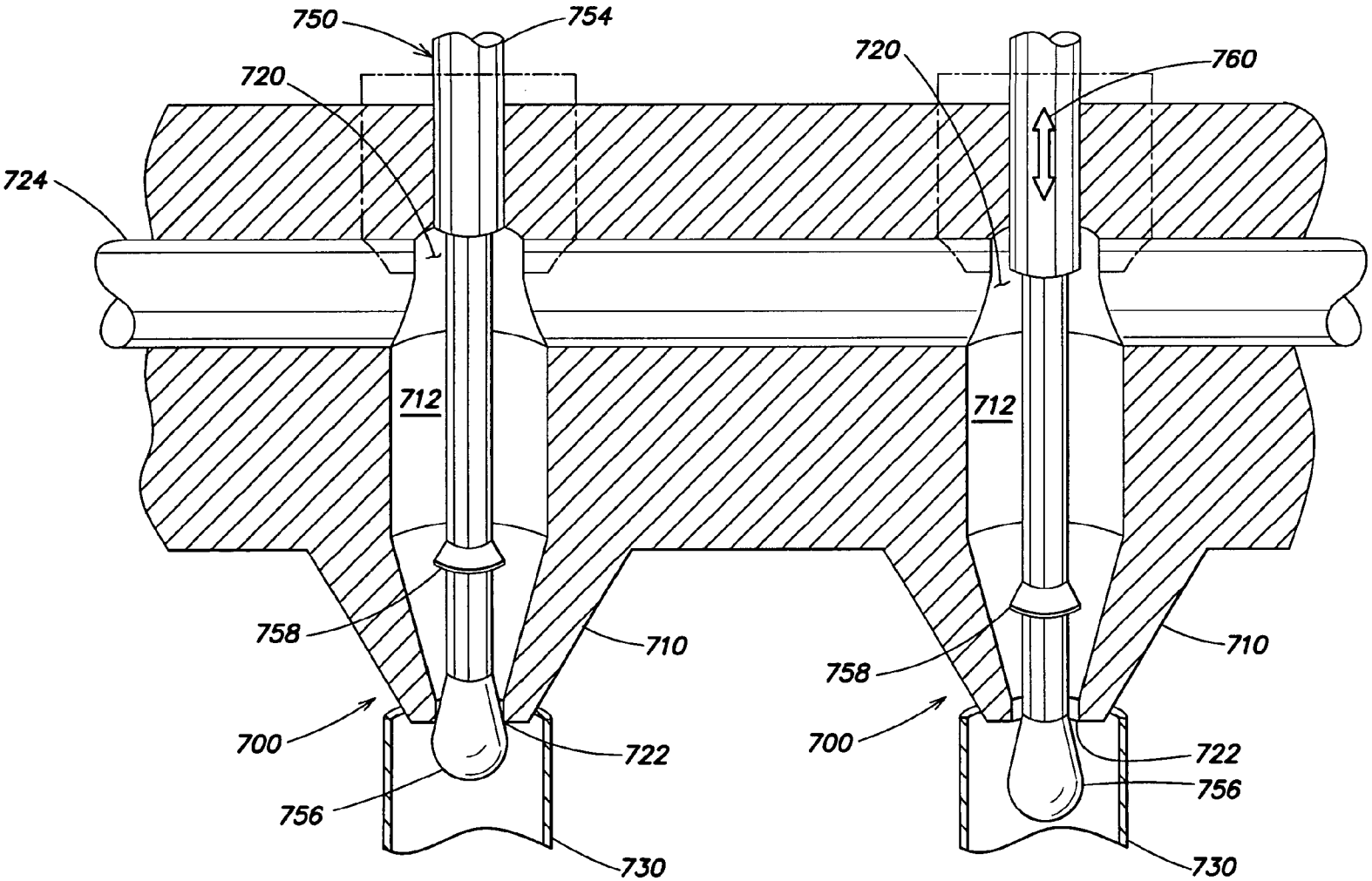
FIG. 24 is an enlarged cross-sectional view of the lower ends of two of the powder dispenser modules shown in FIG. 23.
Figure 25:
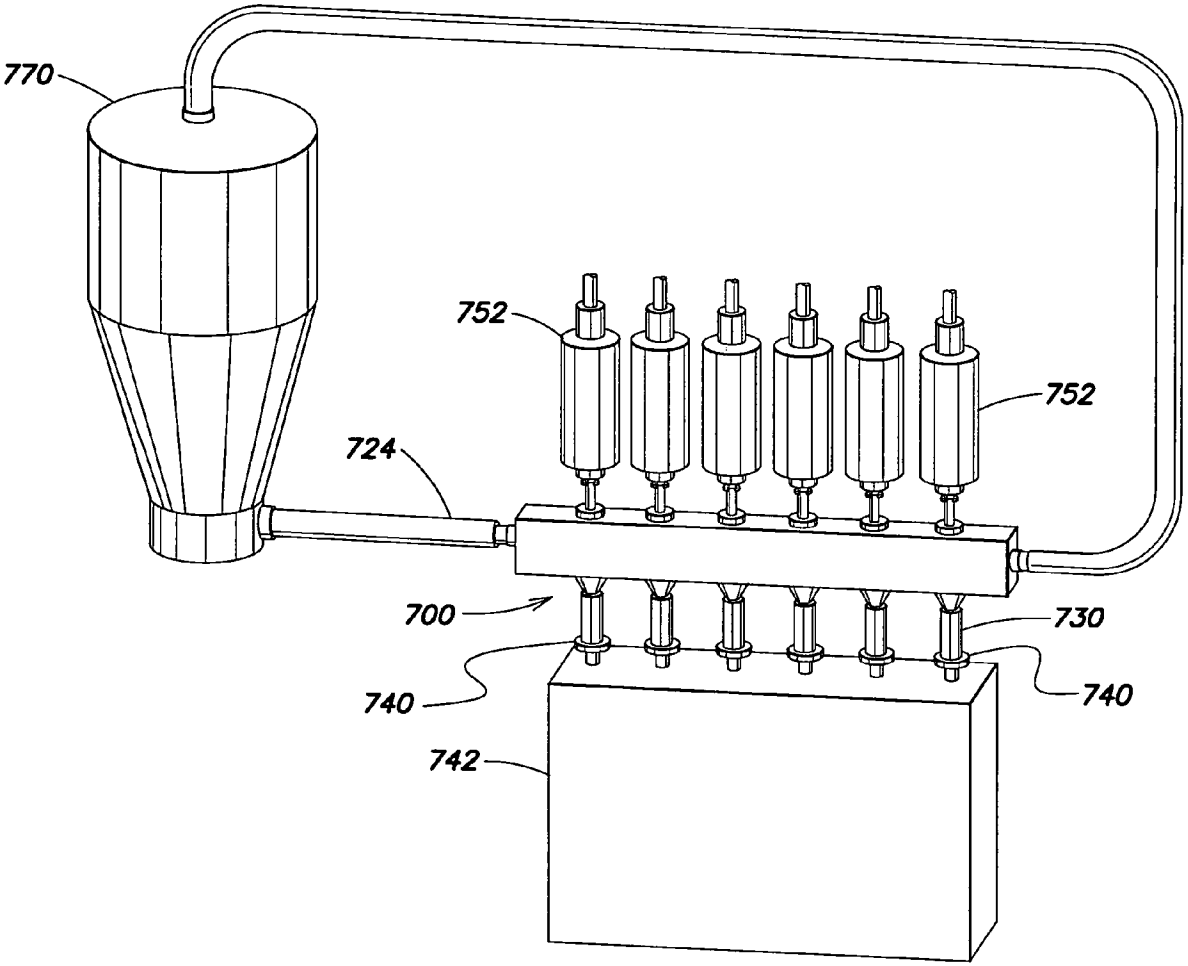
FIG. 25 is a schematic diagram of a powder dispensing and sensing apparatus utilizing the powder dispenser modules shown in FIG. 23.

Powder dispenser modules 700 in accordance with additional embodiments of the invention are shown in FIGS. 23-25. Powder dispenser module 700 includes a powder dispenser housing 710 that defines a powder chamber 712. Powder chamber 712 extends from a powder inlet 720 to a powder outlet 722. A lower portion of powder chamber 712 is tapered inwardly toward powder outlet 722. In the embodiment of FIGS. 23-25, powder dispenser housing 710 is shown as a block having a plurality of powder chambers 712 for multiple powder dispenser modules. In other embodiments, a separate housing can be provided for each powder dispenser module.

Powder inlet 720 is connected to a powder supply conduit 724 through which powder is supplied to each of the powder dispenser modules 700. Powder outlet 722 forms a dispenser nozzle for dispensing powder into cartridges 730. Each of the cartridges 730 rests on a weight sensor cell 740 for sensing the weight of the cartridge 730 during dispensing of powder.

Powder dispenser module 700 further includes a feed wand 750 coupled to an actuator 752. Feed wand 750 may include a shaft 754 coupled to actuator 752, a valve element 756 and a fluidizing element 758. Valve element 756 may be an enlarged portion of shaft 754 that is configured to block powder outlet 722 when valve element 756 is moved to a closed position relative to powder outlet 722, thereby forming a valve at powder outlet 722. In particular, valve element 756 may have a conical shape for contact with the periphery of powder outlet 722. Fluidizing element 758 may be an outwardly extending disk that fluidizes the powder during oscillatory movement of feed wand 750.

Actuator 752 produces linear movement of shaft 754 between an open position of the valve, as shown in the right side of FIG. 24, and a closed position, as shown in the left side of FIG. 24. Actuator 752 also produces oscillatory motion of feed wand 750, in a direction shown by arrow 760 in FIG. 24, when the valve is in the open position. The oscillatory motion of fluidizing element 758 causes powder to be fluidized and to be dispensed through powder outlet 722. After the desired quantity of powder has been dispensed into cartridge 730, as sensed by weight sensor cell 740, the feed wand 750 is moved to the closed position of the valve.

As shown in FIG. 25, a powder transport system 770 may supply powder to an array of powder dispenser modules 700. The powder transport system 770 may include a blower to move a transport gas through the powder transport system for delivery of powder to each of the powder dispenser modules 700. In some embodiments, the powder transport system 770 may operate intermittently to fill each of the powder dispenser modules, followed by one or more powder dispensing cycles wherein powder is dispensed into cartridges 730. It will be understood that different powder transport systems and different arrays of powder dispenser modules may be utilized within the scope of the present invention. In the embodiment of FIGS. 23-25, powder dispenser modules 700 dispense powder vertically through powder chambers 712, and powder is supplied to the powder dispenser modules through a horizontal power supply conduit 724.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A powder dispenser module comprising:

a housing that defines a powder inlet for receiving a powder, a powder outlet, and a conduit connecting the powder inlet and the powder outlet;

a feed wand to move powder through the conduit from the powder inlet to the powder outlet, the feed wand including a lower feed element coupled to a first drive shaft and an upper feed element coupled to a second drive shaft;

a fill valve to control the powder outlet;

a valve actuator to operate the fill valve between open and closed positions;

a first actuator coupled to the first drive shaft to rotate the lower feed element;

a second actuator coupled to the second drive shaft to rotate the upper feed element; and a control system operative to rotate the upper feed element with the valve closed, while maintaining the lower feed element stationary, to open the valve, to rotate the upper feed element and the lower feed element to dispense powder through the open valve to a cartridge, and to close the valve when a desired fill state of the cartridge is reached, wherein the upper feed element and the lower feed element are independently controlled to achieve a desired powder feed operation.

2. A powder dispenser module as defined in claim 1, wherein the first drive shaft comprises an inner shaft and the second drive shaft comprises an outer shaft concentric with the inner shaft.

3. A powder dispenser module as defined in claim 2, wherein the feed wand further includes bearings and seals between the inner shaft and the outer shaft, so that the inner shaft is free to rotate relative to the outer shaft.

4. A powder dispenser module as defined in claim 2, wherein the upper feed element comprises a wire frame and the lower feed element comprises an auger, and wherein the wire frame includes a helical portion and a straight portion above the helical portion.

5. A powder dispenser module as defined in claim 4, further comprising an orifice element, having at least one orifice, positioned adjacent to the powder outlet and a bearing positioned between the feed wand and the orifice element to define a spacing between the auger and the orifice element, wherein the orifice element comprises a granulator that supports the bearing.

6. A powder dispenser module as defined in claim 5, wherein the granulator includes spokes that support a ring for receiving the bearing, the spokes defining orifices for dispensing powder.

7. A powder dispenser module as defined in claim 1, wherein the valve includes a valve member that rotates about an axis perpendicular to an axis of the feed wand.

8. A powder dispenser module as defined in claim 7, wherein the valve member comprises a disk mounted for rotation about an axis in the plane of the disk.

9. A powder dispenser module as defined in claim 8, wherein the disk has a sharp outer edge to limit powder accumulation.

10. Powder dispensing and sensing apparatus including a plurality of powder dispenser modules as defined in claim 1, and comprising:

a support structure to receive a cartridge holder configured to hold cartridges;

the powder dispenser modules configured to dispense powder into respective cartridges;

a powder transport system to deliver powder to the powder dispenser modules;

a sensor module including a plurality of sensor cells to sense respective fill states of each of the cartridges; and the control system configured to control the powder dispenser modules in response to the respective sensed fill states of each of the cartridges, wherein the control system includes an embedded processor in each of the powder dispenser modules, each embedded processor communicating with a respective sensor cell and elements of the powder dispenser module.

11. A method for dispensing powder into a cartridge, comprising:

positioning a cartridge under a dispenser module having a conduit containing a powder and a valve at a lower end of the conduit;

with the valve closed, operating an upper feed element in the conduit while maintaining a lower feed element stationary;

opening the valve;

operating the upper feed element and the lower feed element in the conduit to dispense powder through the open valve to the cartridge; and closing the valve when a desired fill state of the cartridge is reached.

12. Powder dispensing and sensing apparatus including a plurality of powder dispenser modules as defined in claim 1, and comprising:

a support structure to receive a cartridge holder configured to hold at least one row of cartridges;

a powder dispenser assembly including the powder dispenser modules to dispense powder into respective cartridges in the at least one row of cartridges, wherein the powder dispenser assembly includes an array having only one or two rows of the powder dispenser modules, wherein direct powder feeds are provided to each powder dispenser module of the one or two rows of the powder dispenser modules;

a powder transport system to deliver powder to the powder dispenser modules;

a sensor module including a plurality of sensor cells to sense respective fill states of each of the cartridges in the at least one row of cartridges;

a control system to control the powder dispenser modules in response to the respective sensed fill states of each of the cartridges of the at least one row of cartridges; and an actuator to move the at least one row of cartridges relative to the array of powder dispenser modules.

13. Powder dispensing and sensing apparatus as defined in claim 12, wherein the array of powder dispenser modules comprises a single row of powder dispenser modules.

14. Powder dispensing and sensing apparatus as defined in claim 13, wherein the powder transport system is configured to individually deliver powder to each of the powder dispenser modules of the single row of powder dispenser modules.

15. Powder dispensing and sensing apparatus as defined in claim 12, wherein the array of powder dispenser modules comprises two rows of powder dispenser modules.

16. Powder dispensing and sensing apparatus incorporating one or more powder dispenser modules as defined in claim 1.

17. Powder dispensing and sensing apparatus as defined in claim 16, comprising:

a support structure to hold a plurality of cartridges;

the powder dispenser modules configured to dispense powder into respective cartridges;

a powder transport system to deliver powder to the powder dispenser modules;

a sensor module including a plurality of sensor cells to sense respective fill states of each of the cartridges; and the control system configured to control the powder dispenser modules in response to the respective sensed fill states of each of the cartridges.

* * * * *